US009858766B2

(12) United States Patent
Aleksey

(10) Patent No.: US 9,858,766 B2
(45) **Date of Patent: *Jan. 2, 2018**

(54) METHOD, DEVICE, AND COMPUTER-READABLE MEDIUM FOR WAGERING ON A SKILLS-BASED DIGITAL GAMING COMPETITION WITH AN OUT-OF-GAME PEER WAGERING MODULE

(71) Applicant: Russell M. Aleksey, Bend, OR (US)

(72) Inventor: Russell M. Aleksey, Bend, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/491,017

(22) Filed: Apr. 19, 2017

(65) Prior Publication Data

US 2017/0309130 A1 Oct. 26, 2017

Related U.S. Application Data

(63) Continuation of application No. 15/137,554, filed on Apr. 25, 2016, now Pat. No. 9,659,439.

(51) Int. Cl.
*G07F 17/32* (2006.01)

(52) U.S. Cl.
CPC ..... *G07F 17/3288* (2013.01); *G07F 17/3227* (2013.01); *G07F 17/3241* (2013.01)

(58) Field of Classification Search
CPC ..... G07F 17/3225; G07F 17/3276
USPC ..... 463/25, 42, 29
See application file for complete search history.

(56) References Cited

U.S. PATENT DOCUMENTS 7,833,101 B2 11/2010 Lutnick et al.
7,980,948 B2 7/2011 Rowe et al.
8,322,723 B1 12/2012 Bancel et al.
8,414,387 B1 4/2013 Paradise et al.
8,475,266 B2 7/2013 Arnone et al.
8,715,077 B2 5/2014 Paradise et al.
8,771,061 B2 7/2014 Harris et al.
8,821,247 B2 9/2014 Schulzke et al.
(Continued)

OTHER PUBLICATIONS

Pro Gaming League Frequently Asked Questions, https://www.progaming league.com/faq, last accessed on Feb. 4, 2016.
(Continued)

*Primary Examiner* — Michael Cuff
(74) *Attorney, Agent, or Firm* — Buchanan Ingersoll & Rooney PC

(57) ABSTRACT

A method for wagering on a skills-based digital gaming competition, the method executing on a computing device including storage storing a peer-wagering module that is external and distinct from at least one game stored on the storage device or another storage device, the method including: receiving potential game and competitor player data; receiving game competition selection information from the player that includes at least one selected game instance and at least one wager amount; receiving game instance match ID data generated by the transactional server, wherein the game instance match ID data includes at least one of: credential data associated with the player, player wager amount or a board, level, or difficulty setting associated with the selected game instance; and transmitting the game instance match ID data and game initiation data to the game, thereby activating the at least one selected game instance on the computing device.

22 Claims, 15 Drawing Sheets

(56) References Cited

U.S. PATENT DOCUMENTS

| | | | | |
|---|---|---|---|---|
| 8,926,421 | B2 | 1/2015 | Arezina et al. | |
| 8,986,096 | B2 | 3/2015 | Fine et al. | |
| 9,218,716 | B2 | 12/2015 | Barclay et al. | |
| 9,240,101 | B2 | 1/2016 | Paradise et al. | |
| 9,349,246 | B1 | 5/2016 | Paradise et al. | |
| 2006/0211471 | A1 | 9/2006 | Walker et al. | |
| 2007/0087832 | A1 | 4/2007 | Abbott et al. | |
| 2008/0064488 | A1 | 3/2008 | Oh | |
| 2009/0209350 | A1 | 8/2009 | Kelly et al. | |
| 2009/0318219 | A1 | 12/2009 | Koustas et al. | |
| 2010/0222134 | A1 | 9/2010 | Gagner et al. | |
| 2012/0115592 | A1* | 5/2012 | Gagner ..... | G07F 17/32<br>463/25 |
| 2014/0256409 | A1 | 9/2014 | Wood et al. | |
| 2016/0055710 | A1 | 2/2016 | Paradise et al. | |

OTHER PUBLICATIONS

International Search Report (Form PCT/ISA/210) and the Written Opinion of the International Searching Authority (Form PCT/ISA/237) dated Jul. 18, 2017, by the U.S. Patent Office in corresponding International Application No. PCT/US2017/028610 (11 pages).

* cited by examiner

METHOD, DEVICE, AND COMPUTER-READABLE MEDIUM FOR WAGERING ON A SKILLS-BASED DIGITAL GAMING COMPETITION WITH AN OUT-OF-GAME PEER WAGERING MODULE

CROSS-REFERENCE TO RELATED APPLICATIONS

This application claims the benefit of U.S. application Ser. No. 15/137,554, filed on Apr. 25, 2016, the contents of which are incorporated herein by reference in their entirety.

BACKGROUND

The present method, device, and computer-readable medium relate to wagering on a skills-based digital gaming competition with an out-of-game peer-wagering module stored on or accessed by a computing device such as a computer, laptop, tablet, smartphone, gaming console, virtual reality device, etc. An online game is a video game that is either partially or primarily played through the Internet, or another computer network. Online games are ubiquitous, on modern gaming platforms, including but not limited to PCs, consoles, and mobile devices, and span many genres, including but not limited to first-person shooters, strategy, racing, puzzle, combat, sports, and word games.

Online games-of-skill differ from card and casino games, and other online games-of-chance. Online skill-based games are online games in which the outcome of the game instance is determined by the player's physical skill (e.g., fast reaction or dexterity) and/or mental skill (e.g., logic abilities, strategic thinking, trivia knowledge, etc.), unlike games-of-chance, such as card, casino, or fantasy sports games, where the outcome of a game instance is dependent upon non-player inputted variables.

SUMMARY

An exemplary embodiment of the present disclosure provides a method for wagering on a skills-based digital gaming competition, the method executing on a computing device including at least one data processor, a display unit, a transceiver, a user input device that is configured to accept inputs from a player, and a storage device storing a peer-wagering module that is external and distinct from at least one third party game stored on the storage device or another storage device, the peer-wagering module including executable instructions which when executed by the at least one data processor of the computing device perform the method, the method including: receiving, by the peer-wagering module, potential game data and potential competitor player data from a transactional server, wherein the potential game data includes information on at least one game the player can play and the potential competitor player data includes information about at least one potential player the player can compete against in a game; receiving, by the peer-wagering module, selection information from the player that includes at least one selected game instance from among the at least one third party game and at least one wager amount the player wishes to wager on the at least one selected game instance; transmitting, by the peer-wagering module, the selection information to the transactional server; receiving, by the peer-wagering module, game instance match ID data generated by the transactional server or generating the game instance match ID data by the peer-wagering module, wherein the game instance match ID data includes at least one of: credential data associated with the player, and a board, level, or difficulty settings associated with the at least one selected game instance; and transmitting, by the peer-wagering module, the game instance match ID data and game initiation data to the third party game, thereby activating the at least one selected game instance on the computing device for use by the player.

An exemplary embodiment of the present disclosure provides a non-transitory computer readable storage medium storing computer program instructions which, when executed by at least one data processor of a computing device, cause the at least one data processor to implement a method for wagering on a skills-based digital gaming competition, the non-transitory computer readable storage medium storing a peer-wagering module that is external and distinct from at least one third party game, and the peer-wagering module including the computer program instructions, the method including: receiving, by the peer-wagering module, potential game data and potential competitor player data from a transactional server, game server and/or game program stored on a storage medium, wherein the potential game data includes information on at least one game the player can play and the potential competitor player data includes information about at least one potential player the player can compete against in a game; receiving, by the peer-wagering module, selection information from the player that includes a selected game from among the at least one third party game and at least one wager amount the player wishes to wager on the at least one selected game instance; transmitting, by the transceiver of the peer-wagering module, the selection information to the transactional server; receiving, by the peer-wagering module, game instance match ID data generated by the transactional server or generating the game instance match ID data by the peer-wagering module, wherein the game instance match ID data includes at least one of: credential data associated with the player, and a board, level, or difficulty settings associated with the selected at least one third party game; and transmitting, by the peer-wagering module, the game instance match ID data and game initiation data to the third party game, thereby activating the at least one selected game instance on the computing device for use by the player.

An exemplary embodiment of the present disclosure provides a computing device for wagering on a skill-based digital gaming competition, including: at least one data processor; a display unit; a transceiver; a user input device that is configured to accept inputs from a player; and a storage device storing a peer-wagering module that is external and distinct from at least one third party game, the peer-wagering module configured to: receive potential game data and potential competitor player data from a transactional server, wherein the potential game data includes information on at least one game the player can play and the potential competitor player data includes information about at least one potential player the player can compete against in a game; receive selection information from the player that includes at least one selected game instance from among the at least one third party game and at least one wager amount the player wishes to wager on the at least one selected third party game instance; transmit the selection information to the transactional server; generate game instance match ID data or receive game instance match ID data generated by the transactional server, wherein the game instance match ID data includes at least one of: credential data associated with the player, and a board, level, or difficulty settings associated with the at least one selected game instance; and transmit the game instance match ID data and game initiation data to the third party game, thereby activating at least one selected game instance on the computing device for use by the player.

These and other features and advantages of particular embodiments of the method, device, and computer-readable medium for wagering on a skills-based digital gaming competition with an out-of-game peer wagering module will now be described by way of exemplary embodiments to which they are not limited.

BRIEF DESCRIPTION OF THE DRAWINGS

The scope of the present disclosure is best understood from the following detailed description of exemplary embodiments when read in conjunction with the accompanying drawings. Included in the drawings are the following figures.

Figure 1:
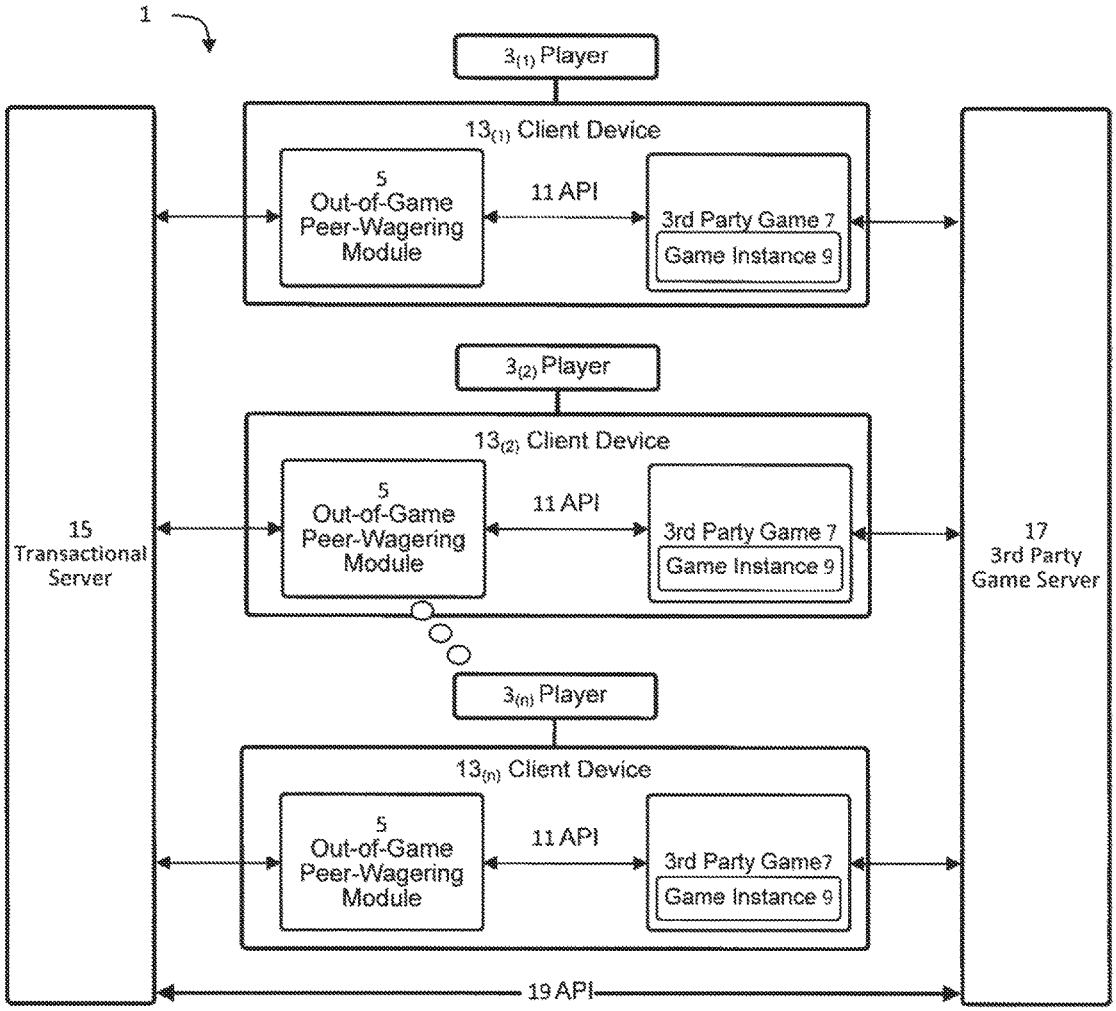
FIG. 1 illustrates a diagram of a system architecture that can be employed in accordance with an exemplary embodiment.

Further areas of applicability of the present disclosure will become apparent from the detailed description provided hereinafter. It should be understood that the detailed description of exemplary embodiments are intended for illustration purposes only and are, therefore, not intended to necessarily limit the scope of the disclosure.

DETAILED DESCRIPTION

This description provides exemplary embodiments only, and is not intended to limit the scope, applicability or configuration of the invention. Rather, the ensuing description of the embodiments will provide those skilled in the art with an enabling description for implementing embodiments of the disclosed methods and systems. Various changes may be made in the function and arrangement of elements without departing from the spirit and scope of the invention as set forth in the appended claims. Thus, various embodiments may omit, substitute, or add various procedures or components as appropriate. For instance, it should be appreciated that in alternative embodiments, the methods may be performed in an order different than that described, and that various steps may be added, omitted or combined. Also, features described with respect to certain embodiments may be combined in various other embodiments. Different aspects and elements of the embodiments may be combined in a similar manner.

The present disclosure relates to a non-embedded, out-of-game peer-wagering module that enables wagering on electronic online games-of-skill with either real world currency and/or online digital currency. Real world currency is the money in common use by nations. Examples are U.S. dollars, British pounds, European euros, etc. Digital currency can be defined as an Internet-based form of currency or medium of exchange distinct from physical currencies (such as banknotes and coins) that exhibits properties similar to physical currencies, but allows for instantaneous transactions and borderless transfer-of-ownership. Both virtual currencies and cryptocurrencies are types of digital currencies. Other examples of digital currency are Bitcoin and Litecoin. The peer-wagering module is "out-of-game" as the peer-wagering module is external and distinct from a third party game, and the peer-wagering module does not alter the third party game and/or the third party game instance user interface. Previously existing online peer-based game-of-skill wagering systems consist of a game instance that includes an embedded "in-game" wagering module that alters an online third party game and the online third party game instance user interface and user experience in order to accommodate the wagering module features and functionality. The "in-game" wagering module thus changes the look, feel, and use of the original game, modifying the gaming experience of the original game. In contrast, the out-of-game peer-wagering module of the present disclosure has advantages over an "in-game" wagering module as a result of the peer-wagering module being external and distinct from a third party game, and thus the peer-wagering module does not alter the third party game and/or the third party game instance user interface.

The skill-based games can be, for example, online video games that are either played over a network on some form of computing device, i.e. client device, (e.g., computer, laptop, tablet, smartphone, video game console (e.g., Xbox, PlayStation®, etc.), virtual reality wearable (e.g., HTC Vive, Oculus Rift, etc.) or utilize a network in some fashion. For example, the electronic game may not be played over the Internet, but the electronic game may connect to the Internet at one or more points of the game (e.g., before the game, beginning of the game, during the game, end of the game, after the game, etc.). The network can be, for example, the Internet or any other electronic network. Online games can range from simple games with very little graphics to games incorporating complex graphics and virtual worlds populated by many players simultaneously. Many online games require skill and strategy and have a social aspect beyond single player games. For example, players compete head-to-head, in a tournament, or for the highest score on a leader board. In an exemplary embodiment, the online third party games may include, but are not limited to, single player, multi-player, and massively multiplayer online games (MMOGs) that are synchronous and/or asynchronous. Asynchronous games are turn-based games in which players take turns and real-time game play is not an issue. For example, a player may leave the game for some time without forfeiting a tournament or game. Exemplary asynchronous games include chess, checkers, etc. Synchronous games are games where there is real time interaction between the game and player or between players. The present disclosure also applies to games that could be both synchronous and asynchronous.

In an exemplary embodiment, the peer-wagering module can utilize a single sign-on (SSO) protocol that enables a player to seamlessly initiate and/or drive open new third party games and associated player established third party game instances without requiring a second sign-on action by a player, i.e. the player does not have to sign into the third party game. Sign-in/sign-on as used herein can be a log-in/log-on. In an exemplary embodiment, the out-of-game peer-wagering module can be an application that is downloaded to a smartphone or tablet, software that is downloaded to a computer, laptop, netbook, etc. or accessed on a online network such as the Internet. The out-of-game peer-wagering module causes electronic backend sign-on handshakes to be performed using third party game sign-on account credentials authorized by the player.

FIG. 1 illustrates a diagram of an exemplary system architecture for wagering on a skills-based digital game. In an exemplary embodiment, the system can include a plurality of players $\mathbf{3}_{(1, 2, \ldots, n)}$ that operate respective computing devices (i.e. client devices) $\mathbf{13}_{(1, 2, \ldots, n)}$. Each computing device 13 includes, for example, at least one data processor 25, a display unit 45, a transceiver 41, a user input device that is configured to accept inputs from a player 3, and a storage device (e.g., memory 29, memory 33, removable storage unit 37, etc.) storing a peer-wagering module 5 that is external and distinct from at least one third party game 7. That is, the peer-wagering module 5 is completely separate and independent from the at least one third party game 7, and thus the peer-wagering module 5 is an "out-of-game" peer-wagering module 5. In an exemplary embodiment, the peer-wagering module 5 is stored at a different memory address as the third party game 7, and the peer-wagering module 5 is not contained within or included in the software of the third party game 7. The computing device 13 can also store at least one third party game 7 on a storage device within the computing device or the third party game 7 can be stored on a storage device external to the computing device 13 (e.g., server, external hard drive, cloud, etc.).

Each third party game 7 includes at least one game instance 9. A third party game 7 can be any of the skill-based games previously discussed. A third party game instance is a game play session to be established by a player or a game play session on standby for player engagement and game session initiation or start event, or an active game play session (post game session initiation or start event), or in reference of a completed game session (post end event) of an online third party game program installed on or accessed by a computing device. Additionally, a third party game instance is the "game session" of the third party game 7.

FIG. 1 also includes a third party game server 17. The third party game server 17 can provide data related to a third party game 7. Each of the third party game instances 9 is in communication with and receiving game data from the third party game server 17. Each third party game instance 9 is associated with an online gaming competition and each player 3 is participating in the online gaming competition. The transactional server 15 can receive a wager amount from each peer-wagering module 5. The transactional server 15 can secure previously deposited funds associated with each of the associated corresponding players 3. The fund amount is equal to the respective wager amount. The funds can be secured such that they cannot be transferred, withdrawn, or secured for a different wager. For example, the wager amount in real world currency and/or online digital currency can be secured by being transferred by the transactional server 15 into an escrow account until the third party game instance associated with the game instance match ID data is complete and the third party game instance results data is validated. Secured funds held in escrow ensure real world currency and/or online digital currency winnings are transferred to third party game instance winners.

The transactional server 15 and the third party game server 17 each include at least one computing system having at least one data processor and a storage device (e.g., computer memory). In an exemplary embodiment, the transactional server 15 can receive game statistics describing the results of the online gaming competition from the third party gaming server 17 and automatically transfer, based on the received game statistics, at least a portion of the secured funds to at least one account associated with at least one of the players 3 associated with the third party game instance 9. In an exemplary embodiment, the transactional server 15 can send a notification of each player's winnings and losses to the peer-wagering module 5. The transactional server 15 can determine if the previously deposited funds associated with a player 3 are less than the wager amount.

In an exemplary embodiment, data is transmitted between the peer-wagering module 5 and the third party game 7 (and in some instances on to the game instance 9) via an API data connection 11. Also, data is transmitted between the transactional server 15 and third party game server 17 via an API data connection 19. In an exemplary embodiment, communication between the transactional server 15, client device 13, and third party game server 17 occurs over an electronic communications network, e.g., the Internet, other computer network, etc. In an exemplary embodiment, the API data communication pathways can be established by, for example, the use of Software Development Kits (SDKs).

In an exemplary embodiment, the out-of-game peer-wagering module 5 is in communication with the third party game 7 accessed and/or installed, for example, on the computing device 13. The out-of-game peer-wagering module 5 transmits/receives third party game and third party game instance data to/from the third party game 7 by the API data connection 11.

In an exemplary embodiment, the transactional server 15 transmits/receives third party game 7 and third party game instance 9 data to/from the third party game server 17 by the API data connection 19.

In an exemplary embodiment, the third party game 7 is in communication with an associated third party game server 17. The third party game 7 can transmit/receive third party game instance 9 results data to/from the associated third party game server 17. In an exemplary embodiment, the transactional server 15 is in communication with the out-of-game peer-wagering module 5. The transactional server 15 transmits/receives data to/from the out-of-game peer-wagering module 5.

In an exemplary embodiment, to begin wagering on a skill-based game, one or a plurality of players 3 independently download/install software for the peer-wagering module 5 onto a computing device 13. In addition, in the exemplary embodiment each player 3 has independently downloaded/installed the software for one or a plurality of third party games 7 onto their computing device 13. However, the third party game 7 does not have to be stored on the computing device 13, but rather can be stored on a storage device that is external to the computing device 13 (external hard drive, server, different computer or device, cloud, etc.). The third party games 7 can be downloaded/installed or accessed via a third party game server 17, online server, or storage medium.

In an exemplary embodiment, players $\mathbf{3}_{(1, 2, \ldots, n)}$ sign-on to the out-of-game peer-wagering module 5 installed on or accessed by their respective computing device $\mathbf{13}_{(1, 2, \ldots, n)}$, using their specific player established, out-of-game peer-wagering module 5 sign on account credentials such as: username and password, Google account sign on credentials, Facebook account sign on credentials, other social medial sign-on account credentials, etc. (step S1 in FIG. 3).

In an exemplary embodiment, upon a player 3 submitting their sign-on credentials to the out-of-game peer-wagering module 5, the out-of-game peer-wagering module 5 transmits a player sign-on credential validation and player 3 eligibility request to the transactional server 15. Player 3 sign-on credential validation is accomplished by, for example, confirming player email, username and password, Google account, Facebook account, other social media account, etc. Additionally, player eligibility is accomplished by, for example, confirming the GPS location of the player's computing device 3 (to conform with local, state, federal and/or provincial laws related to wagering on games of skill), their out-of-game peer-wagering module player account balance and status, player age, validating a player's out-of-game wagering platform sign-on credentials, third party game account sign-on credentials, etc.

A player account for the out-of-game peer-wagering module 5 can be associated with and partially and/or completely managed and stored within the transactional server 15 and/or the out-of-game peer-wagering platform 5.

In an exemplary embodiment, upon a player 3 signing on to the out-of-game peer-wagering module 5, the player 3 can, for example, search for an existing or an opponent established third party game instance 9, find and communicate with prospective opponent players, set-up and/or confirm a new third party game instance 9 and associated single and/or re-occurring wager and game play settings, send social network player invites, drive open third party games and initiate third party game instances, etc. These actions are independent of the third party game 7 and/or the third party game instance user interface and/or user experience.

In an exemplary embodiment, when the player 3 confirms a selected third party game instance 9 and a corresponding wager amount, the out-of-game peer-wagering module 5 generates and/or displays a game instance selection confirmation notification (confirmation 1 of 2) (see, e.g., step S5 in FIG. 3 and FIG. 11) that indicates player 3 has accepted/confirmed the settings and terms of the third party game instance 9. In addition, the game instance selection data can be sent from the out-of-game peer-wagering module 5 to the transactional server 15 (step S6 in FIG. 3).

In an exemplary embodiment, upon receipt of game instance selection confirmation, the transactional server 15 ensures player eligibility and performs data validation to player data for all players $\mathbf{3}_{(1, 2, \ldots, n)}$ associated with the third party game instance 9 established and/or confirmed by the player from within the out-of-game peer-wagering module 5. In an exemplary embodiment, upon receipt of the game instance selection confirmation (confirmation 1 of 2) and player eligibility and data validation, the transactional server 15 generates third party game instance match ID data (step S8 in FIG. 3) and a corresponding third party game initiation protocol. The third party game initiation protocol is an executable computer protocol that can perform, for example, activating and/or opening a closed and/or inactive third party game software installed on one or a plurality of computing devices 13. In an exemplary embodiment, the third party game initiation protocol can include third party game player account sign-on credentials that can include, for example, a player's third party game sign-on username and password, Google account, Facebook account, other social media account credentials required for third party game player account sign-on, etc.

In an exemplary embodiment, partial or complete match ID data can be presented to a player for confirmation (e.g., confirmation 1 of 2 and/or confirmation 2 of 2). Also, in an exemplary embodiment, some or all third party game instance match ID data can be encrypted for the third party game server 17 and not viewable or attainable by the player 3. The transactional server 15 transmits the third party game instance match ID data and the third party game initiation protocol data to the out-of-game peer-wagering module 5. Alternatively, upon receiving the game instance selection confirmation (confirmation 1 of 2), the out-of-game peer-wagering module 5 generates the third party game instance match ID data and the corresponding third party game initiation protocol data.

Figure 3:
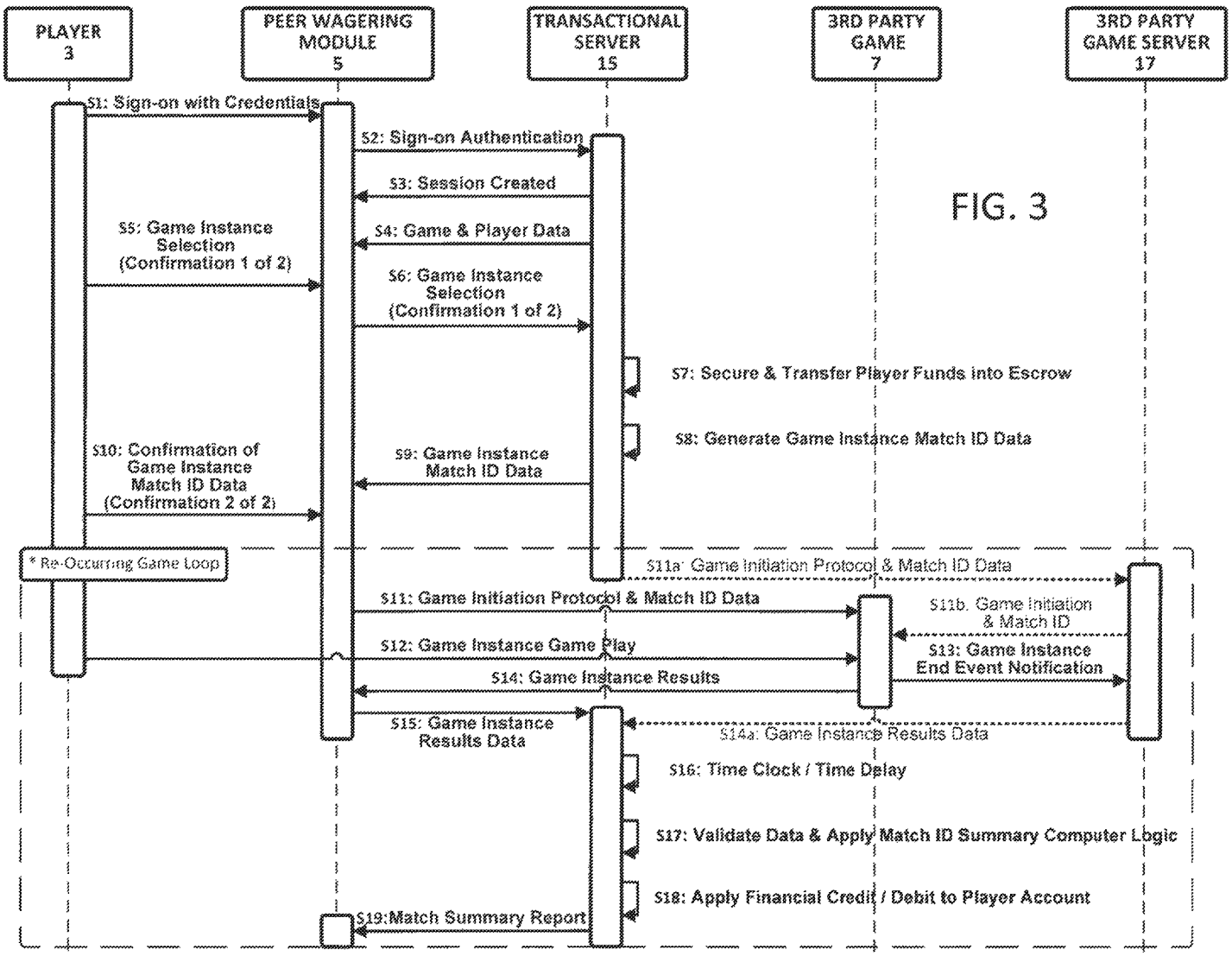
FIG. 3 is a data flow diagram illustrating a method according to an exemplary embodiment.
Figure 12:
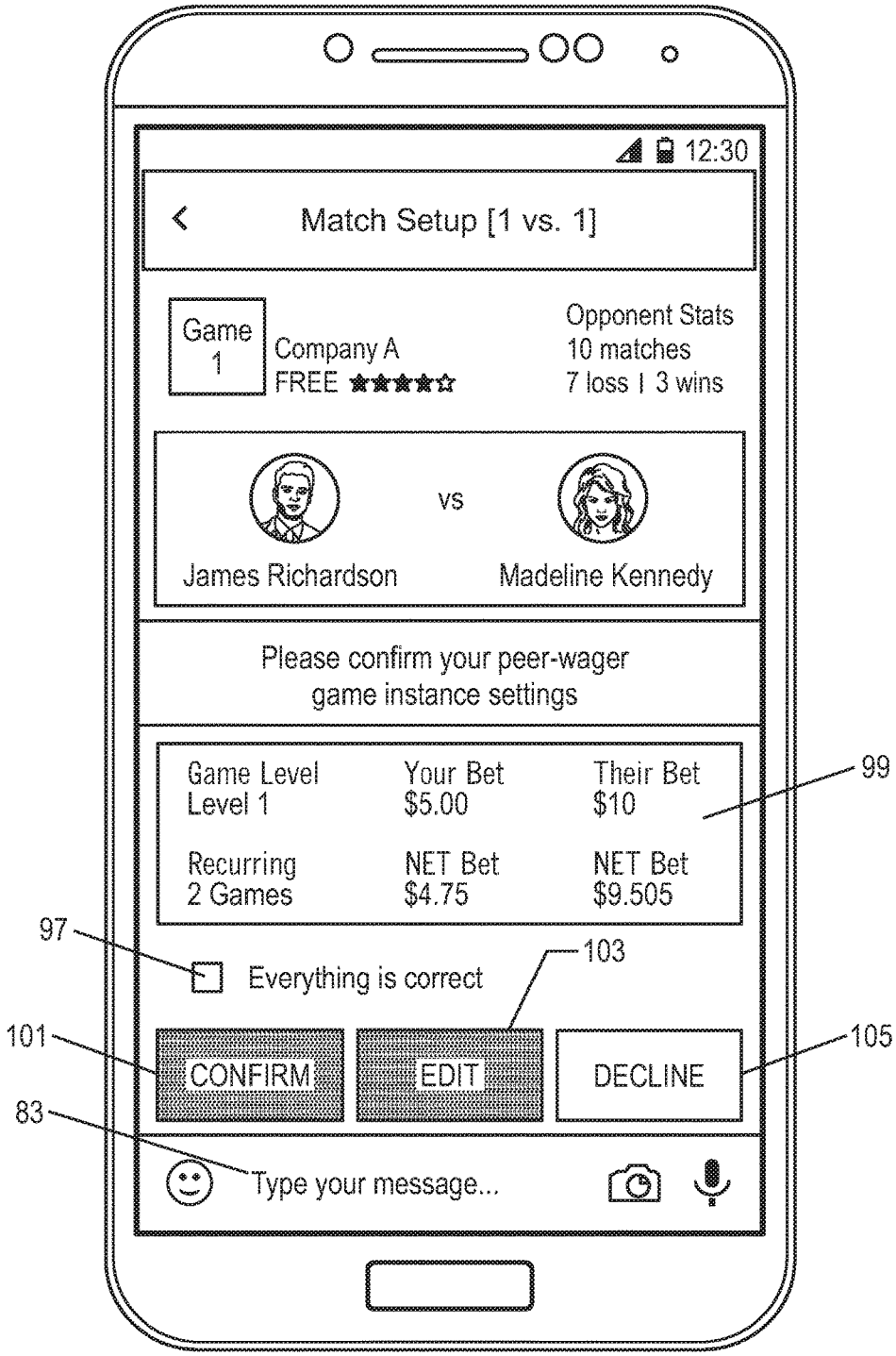
FIG. 12 is a graphical user interface of an exemplary embodiment.

In an exemplary embodiment, upon generation of third party game instance match ID data by either the transactional server 15 (step S8 in FIG. 3) or the out-of-game peer-wagering module 5, the third party game instance match ID data is transmitted to the out-of-game peer-wagering module 5 for player review and final confirmation (i.e., confirmation 2 of 2) (see, e.g., step S10 in FIG. 3 and FIG. 12). Third party game instance match ID data includes, for example, third party game player account sign-on credentials, username(s), player and wager data, game instance board, level and/or difficulty settings, and other data established by a player or players within the out-of-game peer-wagering platform 5 and/or extracted from the transactional server 15 and/or an out-of-game peer wagering platform database. For example, the third party game instance match ID data can include one or more of the following types of information:

A) Match ID Data Set Identification/Reference Information
  - Match ID Data Set Identification Number (e.g., R005B-2192A)
  - Match ID Data Generation Time Stamp B) Peer-Wagering Platform Data
  - Peer-Wagering Platform Username(s)
  - Game Instance Wager (e.g., single player $5, multiplayer $5 vs. $10)
  - Re-occurring Game Instance Setting (e.g., no. of games 2, 5, 7 games etc.)
  - Re-occurring Game Instance Wager Settings (e.g., the amount of money wagered on the re-occurring game instance—game 1: $5, game 2: $8, game 3: $2)

C) 3rd Party Game Data
  - Game Developer/Publisher Name
  - Player(s) Sign-on Credential(s)
  - Game Instance Player Username(s)
  - Game Instance Player/Opponent Settings
    - Player vs. player or team compositions, i.e. team 1 (player 1, player 3, player 5) vs. team 2 (player 2, player 4, player 6)
  - Game Instance Board/Level Setting
  - Game Instance Difficulty Setting D) Computing Device Data
GPS Location of the computing device storing or accessing the peer-wagering module
E) Game Instance or Tournament Status
Waiting for opponent(s) or tournament to begin
Player(s) confirmed/active
F) Game Instance or Tournament Data Eligibility Terms
Tournament Start Time (if applicable)
Tournament End Time (if applicable)

The third party game instance match ID data is formatted for system in-take by the third party game server 17 and/or third party game 7.

In an exemplary embodiment, once the player data has been verified for player eligibility and data validation by the transactional server 15, the transactional server 15 generates third party game instance match ID data (step S8 in FIG. 3). Alternatively, once the player data has been verified for player eligibility and data validation, the out-of-game peer-wagering module 5 partially or completely generates the third party game instance match ID data.

In an exemplary embodiment, the transactional server 15 transmits the third party game instance match ID data to the out-of-game peer-wagering module 5 for review and confirmation by the player. This is a final confirmation of the game instance match ID data by the player 3 (i.e., confirmation 2 of 2) as shown at step S10 of FIG. 3.

In an exemplary embodiment, upon the final player confirmation of the game instance match ID data (confirmation 2 of 2) being received by the out-of-game peer-wagering module 5, the out-of-game peer-wagering module 5 enters into a minimized, reduced, and/or hidden view mode and/or status within or on the computing device 13. Additionally, upon player final confirmation of the third party game instance match ID data being received (confirmation 2 of 2), the transactional server 15 generates the third party game initiation protocol data formatted for intake by third party game 7 and/or third party game server 17. Alternatively, upon player final confirmation (confirmation 2 of 2) being received, the out-of-game peer-wagering module 5 generates the third party game initiation protocol data formatted for third party game 7 and/or third party game server 17 system in-take.

In an exemplary embodiment, the out-of-game peer-wagering module 5 transmits the third party game initiation protocol data and third party game instance match ID data to the third party game 7 associated with the third party game instance match ID data. The data can be transmitted by, for example, an application programming interface (API) data connection 11. Alternatively, the transactional server 15 transmits the third party game initiation protocol data and third party game instance match ID data to the third party game server 17 associated with the third party game instance match ID data. The data is transmitted by, for example, an API data connection 19. Any other data connection could also be used. An API is a set of routines, protocols, and tools for building software and applications. An API expresses a software component in terms of its operations, inputs, outputs, and underlying types, defining functionalities that are independent of their respective implementations, which allows definitions and implementations to vary without compromising the interface. A good API makes it easier to develop a program by providing all the building blocks, which are then put together by the programmer. An API may be for a web-based system, operating system, or database system, and it provides facilities to develop applications for that system using a given programming language.

In an exemplary embodiment, the third party game 7 is now open on the computing device 13 with the third party game instance match ID data populated and/or rendered within a third party game instance 9 ready for game play by the player 3. Next, the player 3 commences game play of the third party game instance 9 as designed by the third party game developer within the third party game 7 and/or the third party game instance 9 user interface (without inclusion or presence of out-of-game peer-wagering module 5 features and/or functionality). In an exemplary embodiment, the player must confirm third party game instance match ID data in order to proceed and initiate peer-wager competitive game play and/or a game session on the selected third party game instance.

In an exemplary embodiment, once the player 3 has completed play of the third party game instance 9, the third party game 7 transmits third party game instance results data to the third party game server 17. Additionally, upon player completion of the third party game instance 9, the third party game 7 transmits third party game instance results data to the out-of-game peer-wagering module 5 via, for example, the API data connection 11 (Step S14 of FIG. 3). The out-of-game peer-wagering module 5 then transmits received third party game instance results data to the transactional server 15 (Step S15 of FIG. 3). Alternatively, upon completion of the third party game instance 9, the third party game server 17 transmits third party game instance results data to the transactional server 15 via the API data connection 19 (Step S14*a* of FIG. 3). The third party game instance results data is the data characterizing a completed, third party game instance, and the data includes, for example, a game instance player username(s), game instance start/stop timestamp, player score(s) and game instance results and statistics, etc. See, e.g., FIGS. 13 and 15.

In an exemplary embodiment, if the third party game instance match ID data includes re-occurring game instance and wager settings for 1, 2, . . . , n sequential and/or non-sequential re-occurring game instances, the transactional server 15 and/or the out-of-game peer-wagering module 5 will transmit, the third party game instance match ID data set for the next third party game instance 9 within the re-occurring match ID data set queue associated with the re-occurring game instance and wager loop settings. The re-occurring game instance and wager loop allows a player to select, wager on, and play multiple sequential and/or non-sequential third party game instances in an un-interrupted, seamless back-to-back and/or intermittent third party game instance gaming session without the need for new wager and new third party game instance set-up within the out-of-game wagering module 5. In an exemplary embodiment, the out-of-game peer-wagering module 5 and/or transactional server web interface can include re-occurring game and wager loop features and functionality.

In an exemplary embodiment, the transactional server 15 can apply player eligibility and data validation computer logic to the received third party game instance results data. Validated game instance player and game instance results data is recorded by, and stored within, the transactional server 15. The transactional server 15 can cross-check and validate completed third party game instance player and game instance results data against, for example, previously validated out-of-game wagering platform data, transactional server data, third party game data, third party game server data, etc.

In an exemplary embodiment, the transactional server 15 and/or the peer-wagering module 5 can include a variable time clock for the acceptance and processing of received third party game instance results data from either the third party game 7 and/or from the third party game server 17. Third party game instance results data not received within an established time clock start and stop time window will not be accepted, and the third party game instance game results data and associated third party game instance match ID data will be flagged for investigation to check if fraud has occurred.

In an exemplary embodiment, the transactional server 15 can apply match summary computer logic to validate and record third party game instance results data for all players $\mathbf{3}_{(1, 2, \ldots, n)}$ associated with the third party game instance match ID data.

In an exemplary embodiment, based on match summary computer logic, the transactional server 15 applies a real world currency and/or online digital currency credit and/or debit to each player's $\mathbf{3}_{(1, 2, \ldots, n)}$ out-of-game peer-wagering module account, associated with the third party game instance match ID data and the match summary computer logic results. The credit and/or debit amount is determined by the match summary computer logic. The match summary computer logic generates a match summary report that summarizes the outcome of the completed peer-wager game instance. The match summary report can be, for example, a formatted report with data and information characterizing player leaderboard position(s), real world currency and/or online digital currency win or loss amount, game instance data and statistics, opponent win and/or loss amount data, player account balance and game play history, new third party game instance recommendations, prompts for further engagement, etc. See, e.g., FIGS. 13 and 15.

In an exemplary embodiment, the transactional server 15 can generate the match summary report and transmit it to the out-of-game peer-wagering platform 5 (step S19 of FIG. 3). In an exemplary embodiment, the transactional server 15 can transmit the match summary report associated with third party game instance match ID data and match summary report to the out-of-game peer-wagering module 5 for player review and next actions.

In the exemplary system architecture of FIG. 1, the peer-wagering module 5 can receive the credential data (step S1 in FIG. 3) associated with the player 3. The credential data can be, for example, credential data that is received via a sign-on by the player 3 into the peer-wagering module 5 or credential data that is received in any other manner. The peer-wagering module 5 can transmit authentication data (step S2 in FIG. 3) to the transactional server 15. The authentication data can be based on the credential data received in step S1. The peer-wagering module 5 can receive a confirmation (step S3 in FIG. 3) of the authentication data (step S2 in FIG. 3) from the transactional server 15. The receipt of the confirmation can log the player 3 into the peer-wagering module 5 and allow use of the peer-wagering module 5. After the credential data (step S1 in FIG. 3) is received by the peer-wagering module 5, additional credential information is not needed by the selected third party game 7.

In an exemplary embodiment, the peer-wagering module 5 can receive potential game data and potential opponent player data (step S4 in FIG. 3) from the transactional server 15. The potential game data can include, for example, information on at least one game the player 3 can play. The potential opponent player data can include, for example, information about at least one potential player the player 3 can compete against in a game.

In an exemplary embodiment, the peer-wagering module 5 can receive selection information (step S5 in FIG. 3) from the player 3 that includes at least one selected game instance 9 from among the at least one third party game 7 and at least one wager amount the player 3 wishes to wager on the at least one selected third party game instance 9. In an exemplary embodiment, the peer-wagering module 5 can also transmit the selection information (step S6 in FIG. 3) to the transactional server 15.

In an exemplary embodiment, the peer-wagering module 5 can generate the game instance match ID data itself or the peer-wagering module 5 can receive the game instance match ID data (step S9 of FIG. 3) generated by the transactional server 15. In an exemplary embodiment, the game instance match ID data S9 includes at least one of: credential data S1 and/or third party game credential data associated with the player 3, player 3 wager(s), game instance board, opponent, level, or difficulty setting associated with the at least one selected game instance 9.

In an exemplary embodiment, the peer-wagering module 5 can transmit the game instance match ID data (step S9 of FIG. 3) and game initiation protocol data to the third party game 7, thereby activating at least one selected game instance 9 on the computing device 13 for use by the player 3. The peer-wagering module 5 does not alter a user interface or user interfaces of the game instance 9 and/or the third party game 7.

In an exemplary embodiment, the peer-wagering module 5 can receive game instance results data (step S14 of FIG. 3) from the third party game 7. In an exemplary embodiment, the peer-wagering module 5 can also receive match summary report data (step S19 of FIG. 3) from the transactional server 15. The match summary report data can include, for example, a win or loss amount for the player 3, an account balance of the player 3, and statistics associated with one or more completed game instances 9 that are completed by the player 3.

In an exemplary embodiment, the game instance 9 that is activated is automatically populated with game instance match ID data that is transmitted from the peer-wagering module 5. Also, when the game instance 9 is activated, a user interface of the peer-wagering module 5 can be minimized or hidden on the computing device 13. For example, the user interface of the peer-wagering module 5 can be minimized or hidden after the final confirmation of the third party game instance match ID data by the player (i.e., confirmation 2 of 2, see step S10 in FIG. 3).

In an exemplary embodiment, the peer-wagering module 5 can receive a game instance selection and a corresponding wager for one or a plurality of game instances 9, and the peer-wagering module 5 causes a plurality of game instances 9 to be launched in a sequential order without additional input from the player 3 (i.e., a re-occurring game loop which is shown, for example, in the bottom half of FIG. 3).

Figure 2A:
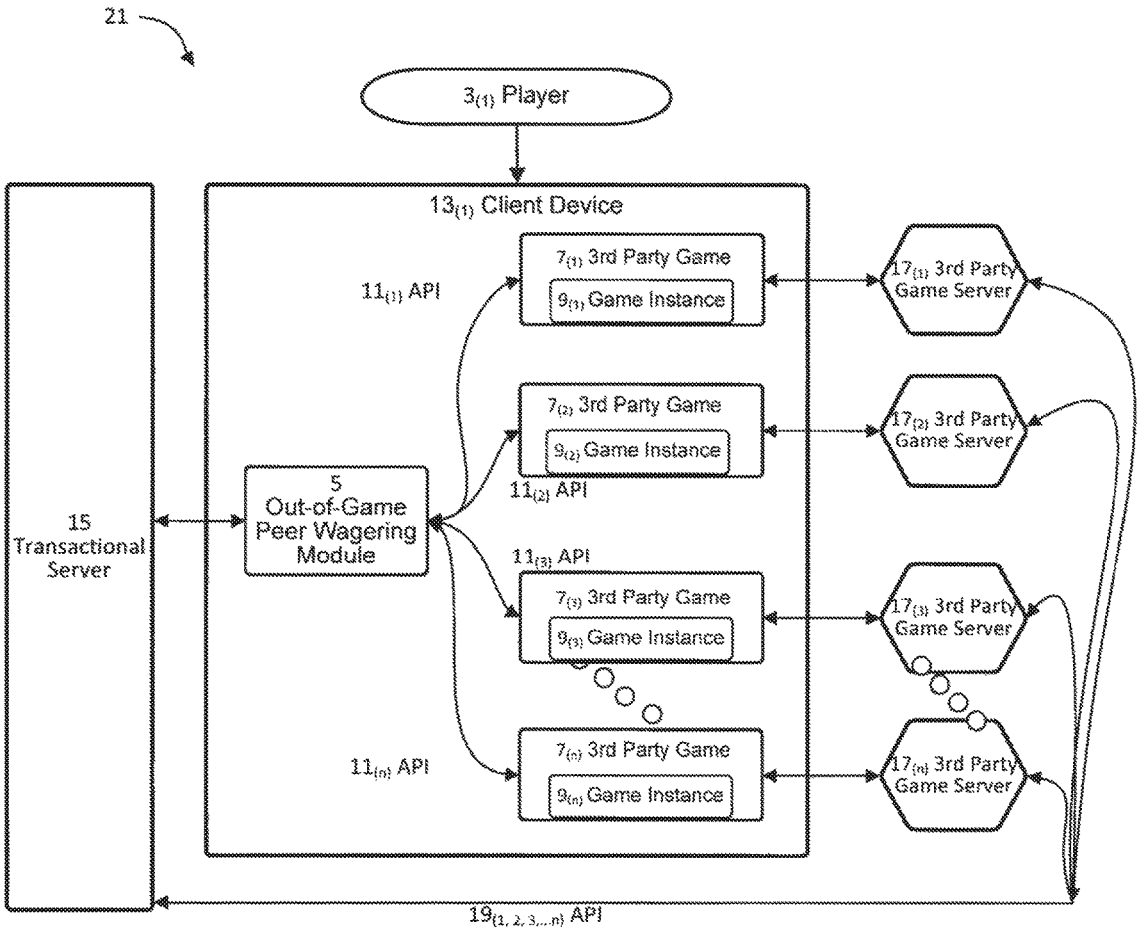
FIG. 2A illustrates a diagram of a system architecture that can be employed in accordance with an exemplary embodiment.

FIG. 2A illustrates a diagram of a system architecture that can be employed in accordance with an exemplary embodiment. The exemplary system enables, facilitates, and manages peer-based wagering outside of a plurality of electronic online third party games 7 installed on one or a plurality of computing devices 13.

In an exemplary embodiment, the out-of-game peer-wagering module 5 transmits/receives data to/from a plurality of third party games 7 installed on the computing device 13. The data can be transmitted by, for example, one or a plurality of API $\mathbf{11}_{(1, 2, \ldots, n)}$ data connections.

In an exemplary embodiment, the transactional server 15 transmits/receives data to/from the plurality of third party game servers $\mathbf{17}_{(1, 2, \ldots, n)}$ that are each associated with a respective third party game $\mathbf{7}_{(1, 2, \ldots, n)}$. The data is sent between the transactional server 15 and each of the plurality of third party game servers $\mathbf{17}_{(1, 2, \ldots, n)}$ by, for example, one or a plurality of API $\mathbf{19}_{(1, 2, \ldots, n)}$ data connections. It is also possible that one third party game server is associated with more than one third party game 7.

In an exemplary embodiment, pertinent data stored by and transmitted by a plurality of game servers $\mathbf{17}_{(1, 2, \ldots, n)}$, and the transactional server 15 to the out-of-game peer-wagering module 5 is displayed and/or used by out-of-game peer-wagering dashboards and/or interfaces to assist the player 3 in navigation, selection, set-up, and/or confirmation of one or more new game instances $\mathbf{9}_{(1, 2, \ldots, n)}$. The data can include, for example, pre-established game instance data, player 3 account and historical data located in any database with an active data connection to the transactional server 15 and/or out-of-game peer-wagering module 5. In an exemplary embodiment, the out-of-game peer-wagering module 5 can perform a game instance search by, for example, game developer, game genre, active and/or open online game instances, online and/or system connected players $\mathbf{3}_{(1, 2, \ldots, n)}$, game instance payout amount(s), real world currency and/or online digital currency available win payouts, etc.

In an exemplary embodiment, single sign-on (SSO) and third party game initiation protocol data enables the out-of-game peer-wagering module 5 to initiate and/or drive open a plurality of third party game $\mathbf{7}_{(1, 2, \ldots, n)}$ software installed, on or accessed by one or a plurality of client devices 13 with player established game instance match ID data and settings pre-loaded, ready for player game play.

In an exemplary embodiment, the transactional server 15 and/or alternatively the out-of-game peer-wagering module 5 simultaneously counts a plurality of third party game instance data sets received from a plurality of third party games $\mathbf{7}_{(1, 2, \ldots, n)}$ and third party game server data sets that correspond with generated and transmitted game instance match ID data sets. The transactional server 15 and/or the out-of-game peer-wagering module 5 transmit the next in queue re-occurring game instance match ID data set associated with the re-occurring game instance settings established by the player within the out-of-game peer-wagering module 5 and re-occurring data embedded within the game instance match ID data set.

Figure 2B:
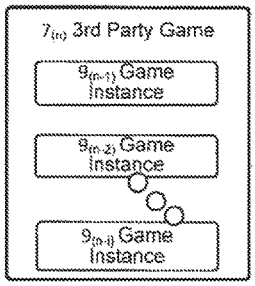
FIG. 2B illustrates a diagram of a third party game that can be employed in accordance with an exemplary embodiment.

FIG. 2B illustrates that one third party game $\mathbf{7}_{(n)}$ can have a plurality of associated game instances. For example, game instance $\mathbf{9}_{(n-1)}$, game instance $\mathbf{9}_{(n-2)}$, and game instance $\mathbf{9}_{(n-i)}$.

Exemplary Methods

FIG. 3 is a data flow diagram illustrating a method according to an exemplary embodiment. After the player 3 has downloaded/installed the out-of-game peer wagering module software onto or accessed by a computing device 3, the out-of-game peer-wagering module 5 prompts the player 3 to create and activate an account (which is a one time event). Information required for account set-up for the out-of-game peer-wagering module 5 activation includes basic profile data that can include, for example, email, Google, Facebook, social media account information, wagering module username and password, picture, location, tag line, anonymous/public visibility settings, the deposit of real world currency and/or online digital currency into a player's out-of-game peer-wagering module account, etc. Deposits and/or transfers of real world currency and/or online digital currency into the out-of-game wagering module associated with the player is accomplished by, for example, an electronic funds transfer (EFT) interface within the out-of-game wagering platform 130 and/or an online interface for the transactional server 15.

In step S1 of FIG. 3, the player 3 signs onto the out-of-game peer-wagering module 5 using their credentials. The player credentials used to sign-on to the out-of-game peer-wagering module 5 can include, for example, email and username, Google account login information, Facebook account login information, or other validated online third party account login information.

In step S2 of FIG. 3, sign-on authentication is performed. The out-of-game peer-wagering module 5 transmits player sign-on credential data to the transactional server 15. In addition, the out-of-game peer-wagering module 5 can perform credential validation of the player sign-on credentials to confirm eligibility of the player.

In step S3 of FIG. 3, a session is created. The transactional server 15 confirms the players sign-on credentials, and the out-of-game peer-wagering module 5 is unlocked, making out-of-game wagering module 5 data and system data available to the interface of the out-of-game peer-wagering module 5.

In step S4 of FIG. 3, the transactional server 15 transmits game and player data. The transactional server 15 transmits third party game data and transactional server third party game instance and match ID data to the out-of-game peer-wagering module 5 for player 3 review on the interface of the out-of-game peer-wagering module 5 and system engagement.

In step S5 of FIG. 3, selection of the game instance is performed. Within an interface of the out-of-game peer-wagering module (e.g., FIG. 8), the player 3 locates, selects, and confirms a third party game instance 9. This selection by the player 3 of the game instance is a first confirmation of the game instance (confirmation 1 of 2).

In step S6 of FIG. 3, the out-of-game peer-wagering module 5 transmits, player confirmed, third party game instance data to the transactional server 15.

In step S7 of FIG. 3, player funds are placed into escrow. The transactional server 15 can check a game instance wager amount or wager amounts against the player's account balance to ensure the player has the necessary funds for the game instance wager or wagers. The transactional server 15 secures real world currency and/or online digital currency funds of the player that have been previously deposited into the player's out-of-game peer-wagering module account. The secured funds are placed in escrow until the third party game instance 9 is complete and match results computer logic has been applied to third party game instance results data. The secured funds are equal to or greater than the player's wager amount. Secured player funds cannot be used for other wagers, withdrawn, or secured for any other purpose.

In step S8 of FIG. 3, game instance match ID data is generated. The transactional server 15 can generate third party game instance match ID data. Alternatively, the out-of-game peer-wagering module 5 can generate and transmit third party game instance match ID data.

In step S9 of FIG. 3, game instance match ID data is transmitted to the out-of-game peer-wagering module 5. The transactional server 15 transmits third party game instance match ID data to the out-of-game peer-wagering module 5 for final player review and final confirmation (confirmation 2 of 2). FIG. 12 illustrates an exemplary interface that shows the third party game instance match ID data.

In step S10 of FIG. 3, the player 3 confirms the game instance match ID data. The player 3 can decline, edit, or confirm the presented third party game instance match ID data (for example by using buttons 101, 103, and 105 in FIG. 12). The player 3 confirms third party game instance match ID data by using the out-of-game peer-wagering module 5. This is the player's final confirmation notification (confirmation 2 of 2) received by the out-of-game peer-wagering module 5. Upon the player 3 confirming third party game instance match ID data, the out-of-game peer-wagering module 5 can enter into a minimized and/or hidden view mode on and/or in the computing device 13. Also, the out-of-game peer-wagering module 5 can transmit the final confirmation notification (confirmation 2 of 2) to the transactional server 15.

In step S11 of FIG. 3, game initiation protocol data and match ID data are transmitted. The out-of-game peer-wagering module 5 transmits the third party game initiation protocol data and the third party game instance match ID data to the third party game 7 by, for example, the API 11 data connection. Alternatively, in step S11*a* the transactional server 15 can transmit the third party game initiation protocol data and third party game instance match ID data to the third party game server 17. In step S11*b* of FIG. 3, the third party game server 17 can transmit the third party game initiation protocol data and third party game instance match ID data to the third party game 7.

Before step S12 of FIG. 3, the game instance 9 is started. The third party game program opens and/or activates on the computing device 13. Additionally, the now open and/or activate third party game 7 loads and/or populates a third party game instance with the third party game instance match ID data. The third party game instance game session is now ready to be played by the player 3.

In step S12 of FIG. 3, the player 3 begins third party game instance game play.

In step S13 of FIG. 3, a game instance end event notification is sent. After the third party game instance is complete, and all players 3 have completed third party game instance game play, the third party game 7 confirms third party game instance completion and transmits a game instance end event notification to the third party game server 17.

In step S14 of FIG. 3, results of the game instance are received. The third party game 7 transmits third party game instance results data to the out-of-game peer-wagering module 5. The third party game instance results data can be transferred by, for example, the API 11 data connection. In step S15 of FIG. 3, the peer-wagering module 5 transmits the third party game instance results to the transactional server 15. Alternatively, the third party game server 17 can transmit the third party game instance results data to the transactional server 15. The data can be transferred by, for example, the API 19 data connection.

The bottom half of FIG. 3 within the dashed rectangle shows steps that can be performed during a re-occurring game loop sequence. If the player 3 sets up and confirms re-occurring game instance and wager game loop settings beyond a single gaming instance (i.e. multiple games), the re-occurring game instance 9 and wager loop interstitial can activate upon the out-of-game peer-wagering module 5 and/or the transactional server 15 receiving third party game instance results data from either the third party game 7 and/or the third party game server 17. Re-occurring game instance and wager loop interstitial activation transmits the second third party game instance match ID data set in the player established re-occurring game instance match ID data set queue.

In step S16 of FIG. 3, time delay/time clock data is used. The transactional server 15 includes a variable time clock for accepting and processing incoming third party game instance results data from either a third party game 7 by way of the out-of-game peer-wagering module 5 and/or directly from a third party game server 17. The time clock and/or time delay starts and stops according to, for example, administrator established start and stop time clock settings (e.g., START: 10:00 PM (PST), 01.01.2016; STOP: 12:00 AM (PST), 02.01.2016, etc.). Data that is received outside of or beyond the established time clock settings are not eligible for match summary consideration as described below. Additional data received outside of and/or beyond the established time clock setting will be flagged for investigation.

In step S17 of FIG. 3, the transactional server 15 can apply game instance match summary computer logic to the third party game instance game results data received within the allowable time clock settings by generating a game instance match summary report.

In step S18 of FIG. 3, a financial credit and/or debit is applied to a player 3 account(s). The transactional server 15 applies a real world currency and/or online digital currency credit and/or debit to all player 3 accounts associated with the third party game instance 9. In an exemplary embodiment, the credit and/or debit amount can be determined by the game instance match summary computer logic of the transactional server 15 and/or the out-of-game peer-wagering module 5.

Figure 13:
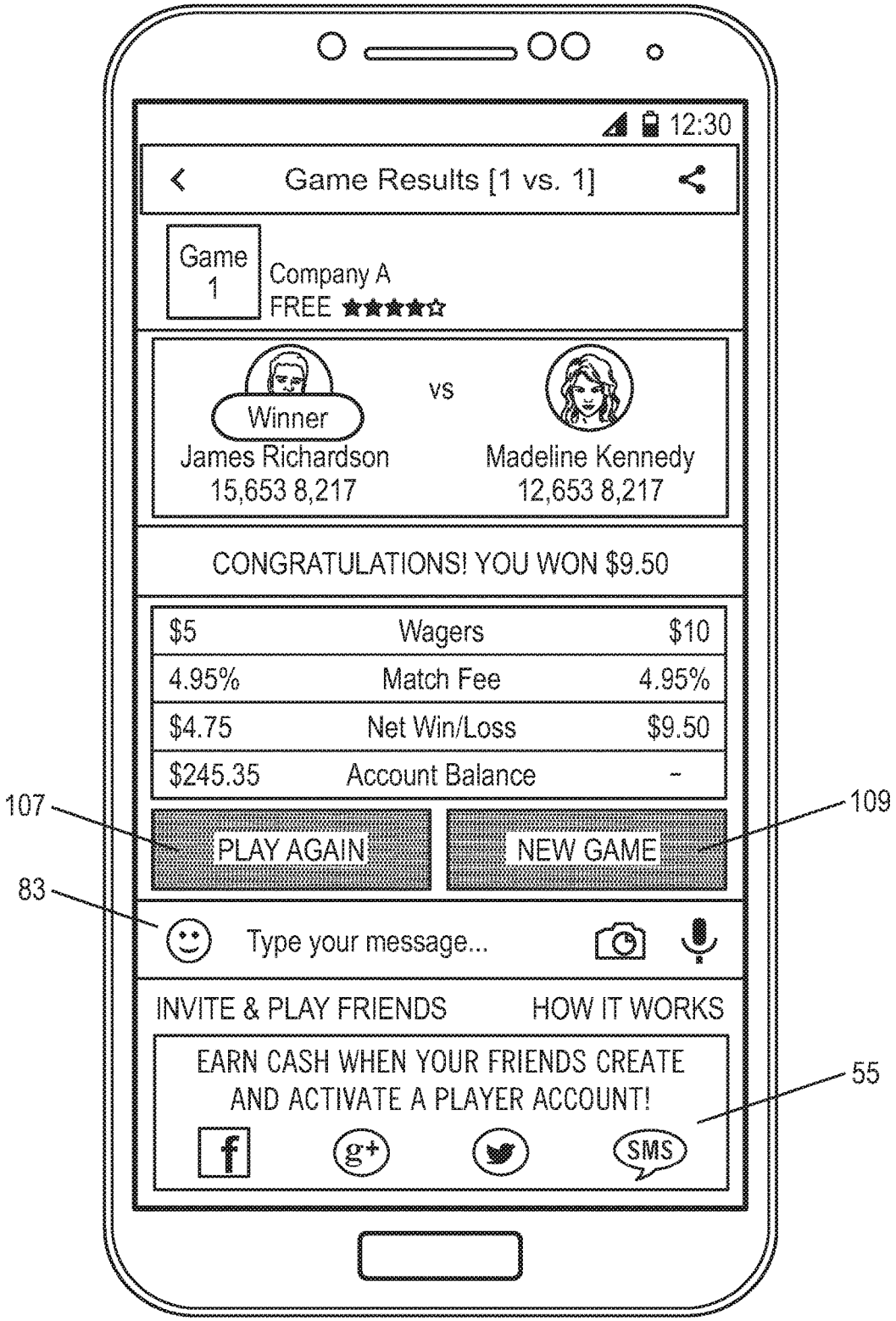
FIG. 13 is a graphical user interface of an exemplary embodiment.
Figure 14:
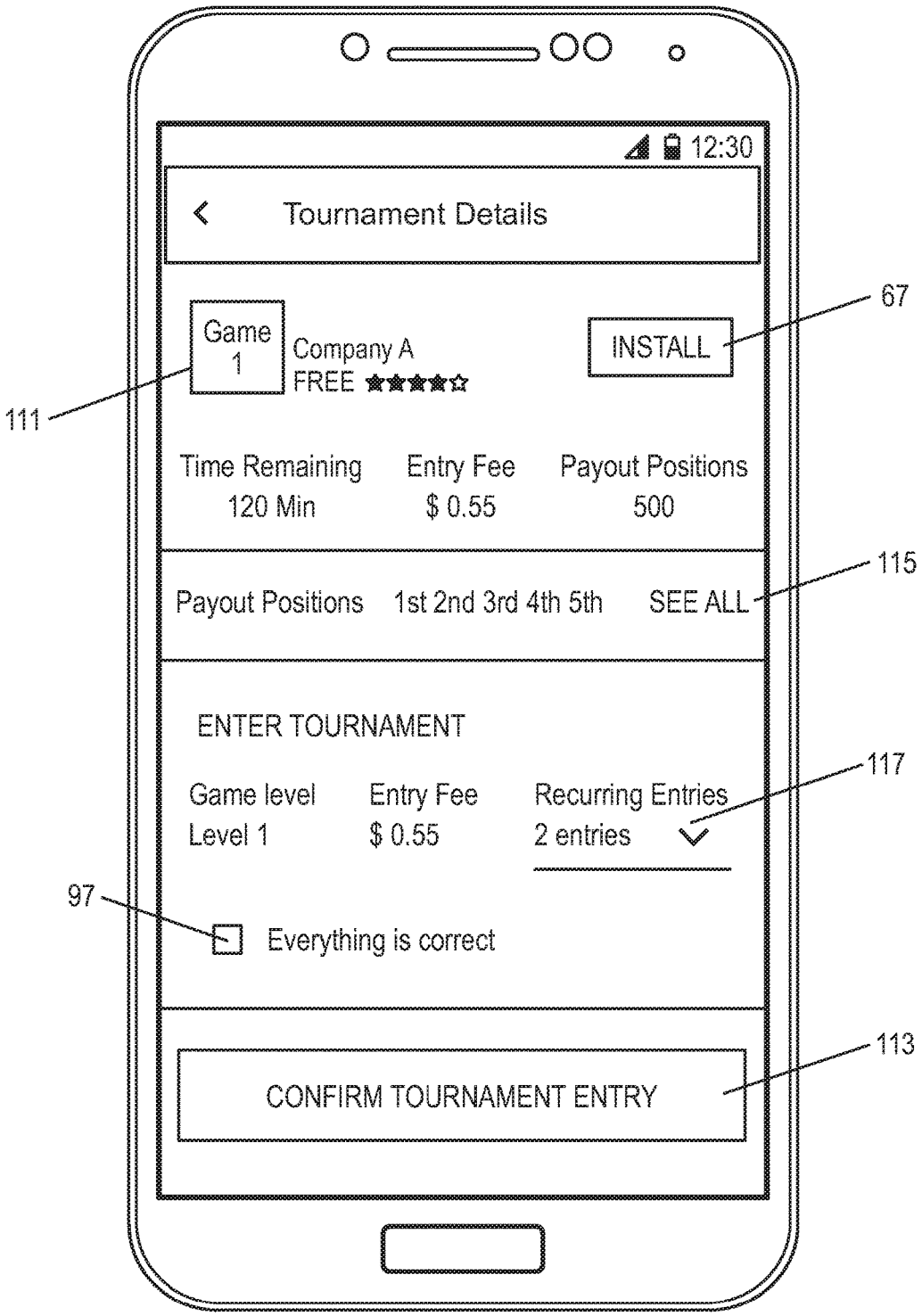
FIG. 14 is a graphical user interface of an exemplary embodiment.
Figure 15:
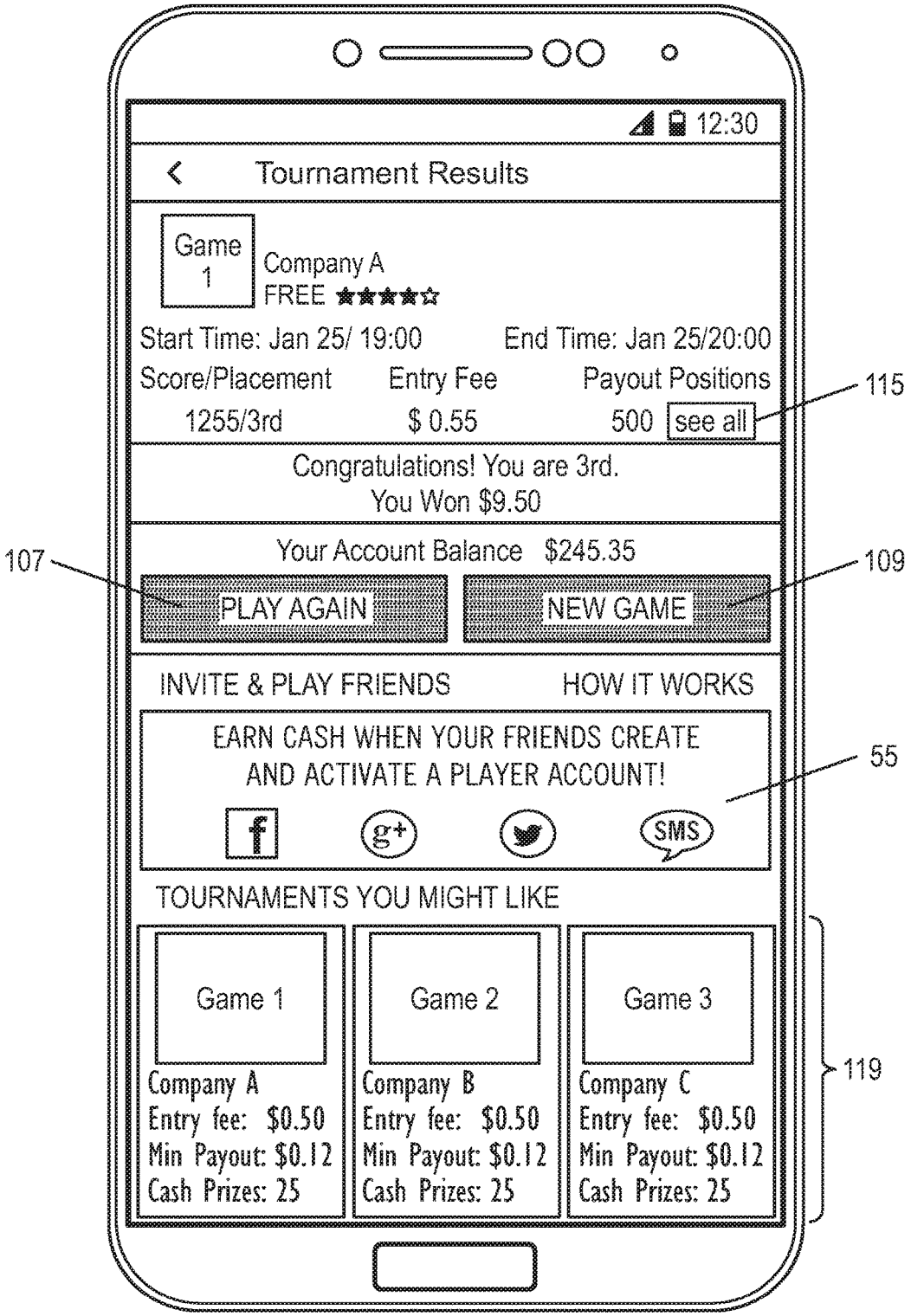
FIG. 15 is a graphical user interface of an exemplary embodiment.

In step S18 of FIG. 3, the match summary report is transmitted. The transactional server 15 transmits the third party game instance match summary report to the out-of-game peer-wagering module 5 for player review and next action. FIGS. 13, 14, and 15 show exemplary game instance match summary reports generated by the transactional server 15.

Figure 6:
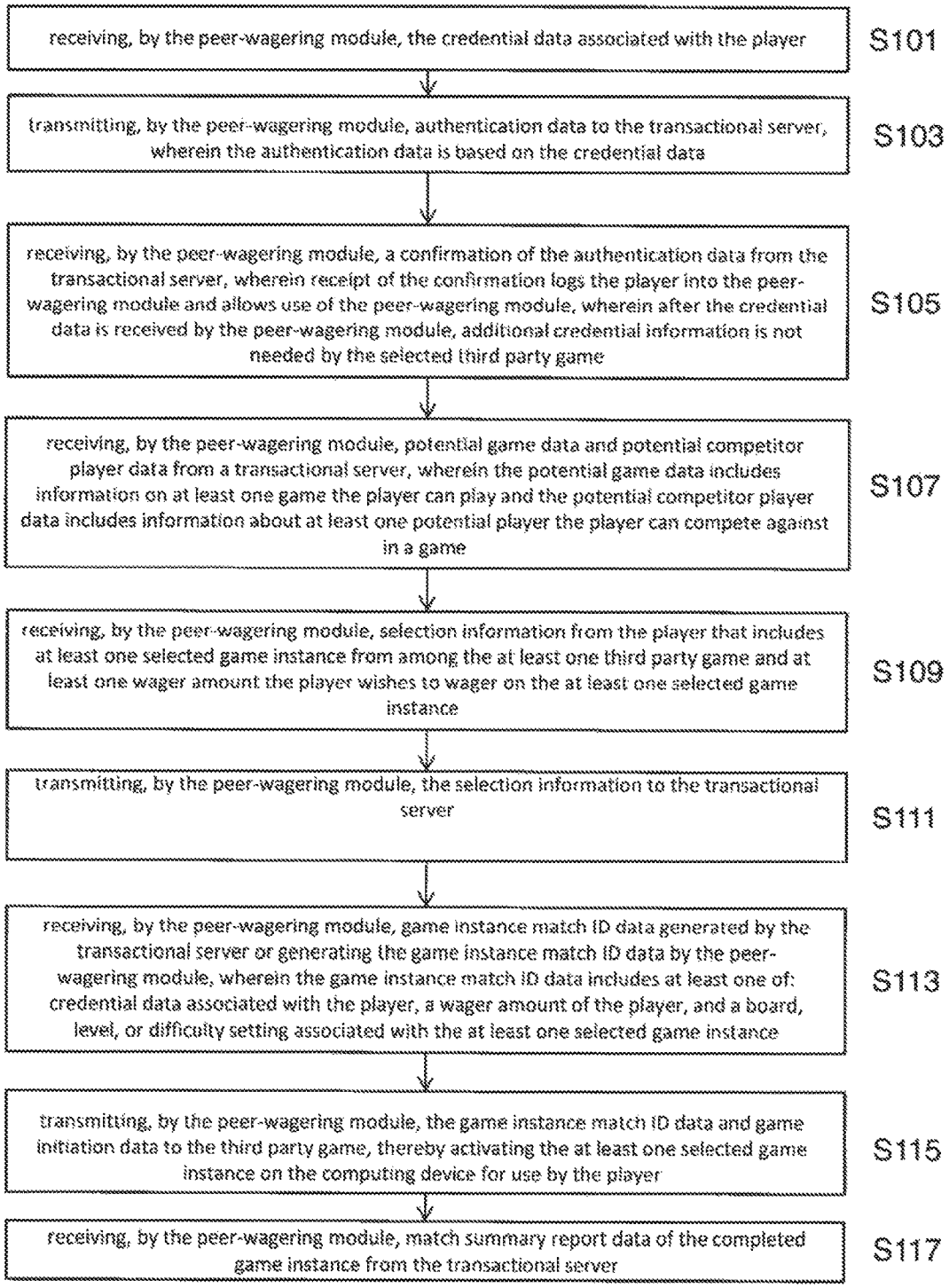
FIG. 6 is a flow chart illustrating a method according to an exemplary embodiment.

FIG. 6 is a flow chart illustrating an exemplary method for wagering on a skills-based digital gaming competition, the method executing on the computing device 13. The computing device 13 including at least one data processor (e.g., processor 25), a display unit (e.g., display 45), a transceiver (e.g., communications interface 41), a user input device that is configured to accept inputs from a player 3 (i.e., touchscreen, mouse, keyboard, etc.), and a storage device (e.g., main memory 29, secondary memory 31, etc.) storing the peer-wagering module 5 that is external and distinct from at least one third party game 7 stored on the storage device or another storage device (e.g., removable storage unit 37, cloud, external server, etc.). The peer-wagering module 5 includes executable instructions which when executed by the at least one data processor of the computing device 13 performs a method including receiving, by the peer-wagering module 5, potential game and game instance data and potential competitor player 3 data from a transactional server 15, wherein the potential game 7 and game instance 9 data includes information on at least one game the player can play and the potential competitor player 3 data includes information about at least one potential player the player 3 can compete against in a game instance 9 (step S107).

The method can also include receiving, by the peer-wagering module 5, selection information from the player 3 that includes at least one selected game instance 9 from among the at least one third party game 7 and at least one wager amount the player 3 wishes to wager on the at least one selected game instance 9 (step S109).

The method can also include transmitting, by the peer-wagering module 5, the selection information to the transactional server 15 (step S111).

The method can also include receiving, by the peer-wagering module 5, game instance match ID data generated by the transactional server 15 or generating the game instance match ID data by the peer-wagering module 5, wherein the game instance match ID data includes at least one of: credential data S1 associated with the player 3, player 3 wager(s), and a board, level, or difficulty settings associated with the at least one selected game instance 9 (step S113).

The method can also include transmitting, by the peer-wagering module 5, the game instance match ID data and game initiation data to the third party game 7, thereby activating the at least one selected game instance 9 on the computing device 13 for use by the player 3 (step S115).

The method can also include receiving, by the peer-wagering module 5, match summary report data of the completed game instance from the transactional server 15 (step S117).

Prior to the receiving of the potential game data and the potential competitor player data from the transactional server 15, the method can include receiving, by the peer-wagering module 5, the credential data associated with the player 3 (step S101). Transmitting, by the peer-wagering module 5, authentication data to the transactional server 15, wherein the authentication data is based on the credential data (step S103). The method can also include receiving, by the peer-wagering module 5, a confirmation of the authentication data from the transactional server 15, wherein receipt of the confirmation signs the player 3 into the peer-wagering module 5 and allows use of the peer-wagering module 5, wherein after the credential data is received by the peer-wagering module 5, additional credential information is not needed by the selected third party game 7 (step S105).

In an exemplary embodiment, the peer-wagering module 5 does not alter a user interface or user interfaces of the game instance 9 and the third party game 7. In an exemplary embodiment, the game instance 9 that is activated is automatically populated with data from the game instance match ID data that is transmitted from the peer-wagering module 5. In an exemplary embodiment, the game instance 9 is activated, a user interface of the peer-wagering module 5 is minimized or hidden on the computing device 13.

In an exemplary embodiment, the method of FIG. 6 further includes receiving, by the peer-wagering module 5, a game instance selection and a corresponding wager for one or a plurality of game instances 9, and the peer-wagering module 5 causes a plurality of game instances 9 to be launched in a sequential order without additional input from the player 3.

In an exemplary embodiment, the method of FIG. 6 further includes receiving, by the peer-wagering module 5, game instance results data from the third party game 7; and receiving, by the peer-wagering module 5, match summary report data from the transaction server 15, wherein the match summary report data can include win or loss amount for the player 3, account balance of the player 3, and statistics associated with one or more completed game instances 9 completed by the player 3.

In an exemplary embodiment, a non-transitory computer readable storage medium stores computer program instructions which, when executed by at least one data processor of a computing device 13, cause the at least one data processor to implement a method for wagering on a skills-based digital gaming competition, the non-transitory computer readable storage medium storing the peer-wagering module 5 that is external and distinct from at least one third party game 7, and the peer-wagering module 5 including the computer program instructions. The computer program instructions are executed to cause the at least one data processor to perform one or more of the steps described in the present disclosure.

Figure 4:
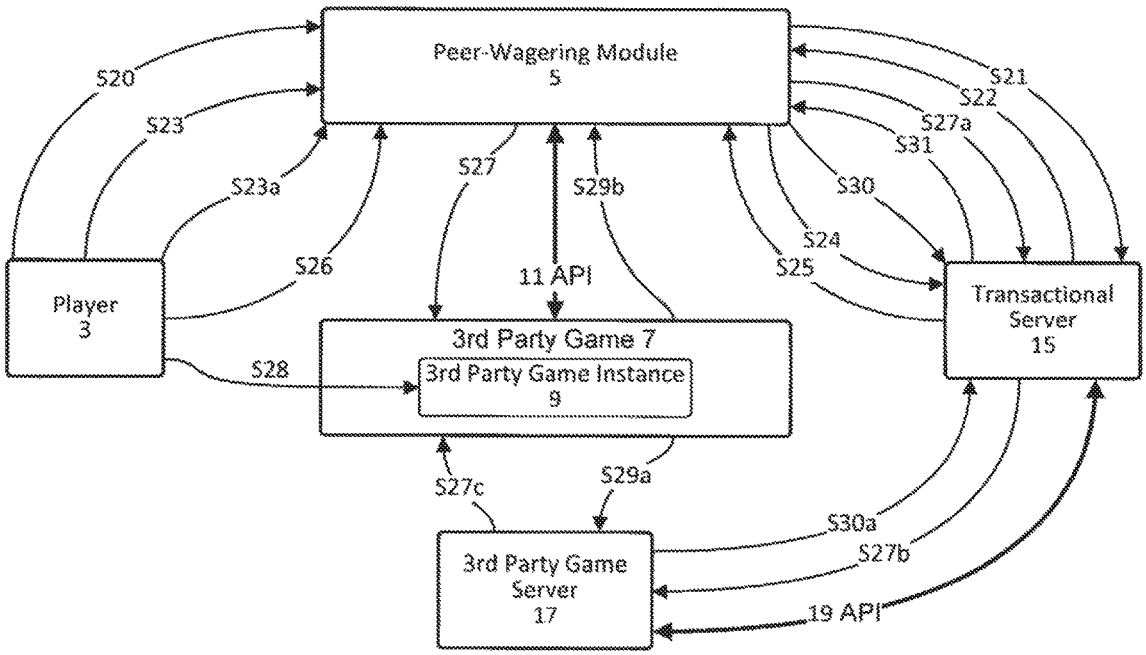
FIG. 4 is a data flow diagram illustrating a method according to an exemplary embodiment.

FIG. 4 illustrates an exemplary system and the data flows between the various components of the system. On the computing device 13, the player 3 signs into the out-of-game peer-wagering module 5 using, for example, username and password, Google account, Facebook account, or other social media account information (step S20).

In step S21, the out-of-game peer-wagering module 5 transmits a player 3 sign-in credential authentication request to the transactional server 15. Additionally, the out-of-game peer-wagering module 5 can determine player eligibility based on the player sign-in credentials.

In step S22, upon receipt of a player sign-on credential authentication request, the transactional server 15 applies player eligibility computer logic to the received player sign-on credential authentication request data. Authenticated and/or confirmed player credentials by either the out-of-game peer-wagering platform 5 and/or the transactional server 15 triggers the out-of-game peer-wagering module 5 to unlock and report and/or render stored out-of-game peer-wagering module 5 data. Additionally, upon account validation, the transactional server 15 transmits transactional server stored data in addition to the third party game server 17 data by, for example, API 19 data connection/connections.

In step S23, the player 3 is now able to browse third party games by developer, genre, prospective opponent players 3, open game instances 9, and/or set-up a third party game instance, find and communicate with prospective opponent players, set wagers, confirm and initiate third party game instance game play, review and edit account details, and add real world currency and/or online digital currency to their player account. Player confirmation of third party game instance data (player game instance confirmation 1 of 2) is received by the out-of-game peer-wagering module 5.

Step S23*a* illustrates multiple communication exchanges and/or player 3 inputs, which can include for example, multiple communications with opponent player(s) 3, and/or the editing of third party game instance data and/or settings. The player 3 communications and game instance 9 edits and/or revisions can include, for example, opponent player instant messaging, edits to the game instance settings, wager amount(s) and/or re-occurring game loop settings. Player confirmation of the third party game instance data transmits player game instance confirmation 1 of 2 to the out-of-game peer-wagering module 5.

In step S24, the out-of-game peer-wagering module 5 transmits player confirmation 1 of 2 and a third party game instance match ID data request to the transactional server 15. Additionally, player confirmation 1 of 2 can trigger the out-of-game peer-wagering module 5 to generate partial or complete corresponding third party game instance match ID data and/or third party game initiation protocol data.

In step S25, the transactional server 15 generates and transmits third party game instance match ID data and third party game initiation protocol data to the out-of-game peer-wagering module 5 for player 3 review and confirmation 2 of 2.

In step S26, the player 3 confirms third party game instance match ID data transmitting player confirmation 2 of 2 to the out-of-game peer-wagering module 5.

In step S27, player confirmation 2 of 2 triggers the out-of-game peer-wagering module 5 to enter into a minimized or hidden window view or status within and/or on the computing device 13. Player funds that are equal to or greater than the wager amount of the player 3 can be secured by the transactional server 15 and transferred into an escrow account. Additionally, player 3 confirmation of 2 of 2 triggers out-of-game peer-wagering module 5 to transmit third party game initiation protocol data and third party game instance match ID data to the third party game 7. The data can be transmitted by, for example, the API 11 data connection. The third party game 7 is now open and populated with third party game instance match ID data established by the player 3 within the out-of-game peer-wagering module 5. Alternatively, in step S27*a*, the out-of-game peer-wagering module 5 transmits, player confirmation 2 of 2 notification to the transactional server 15. In step S27*b*, the transactional server 15 transmits the third party game initiation protocol data and the third party game instance match ID data to the third party game server 17. The data can be transmitted by, for example, the API 19 data connection. In step S27*c*, the third party game server 17 transmits the third party game initiation protocol data and third party game instance match ID data to the third party game 7 installed on the computing device 13. The third party game is now open and populated with third party game instance match ID data, established by the player 3 within the out-of-game peer-wagering module 5.

In step S28, the player 3 commences third party game instance game play, as designed by the third party game developer, without the presence or inclusion of out-of-game peer-wagering module 5 features or functionality.

In step S29*a*, upon third party game instance completion, the third party game 7 can transmit, for example, a third party game instance game end event notification and third party game instance results data to the third party game server 17. Additionally, the third party game 7 can transmit the third party game instance end event notification and third party game instance results data to the out-of-game peer-wagering module 5 by, for example, the API 11 data connection.

In step S30, the out-of-game peer-wagering module 5 can transmit third party game instance results data to the transactional server 15. In step S30*a*, the third party game server 17 can transmit third party game instance results data to the transactional server 15 by, for example, the API 19 data connection.

In step S31, the transactional server 15 applies match summary computer logic to eligible and validated third party game instance results data. Additionally, based on match summary computer logic results, the transactional server 15 applies a real world currency and/or online digital currency credit and/or debit to all player accounts associated with the third party game instance match ID data and match summary computer logic results. The credit and/or debit amount is determined by the transactional server 15 match summary computer logic results. Also, the transactional server 15 can generate and transmit the corresponding third party game instance match summary report to the out-of-game peer-wagering module 5 for player review and next actions.

Mobile Phone/Computer System Architecture

Figure 5:
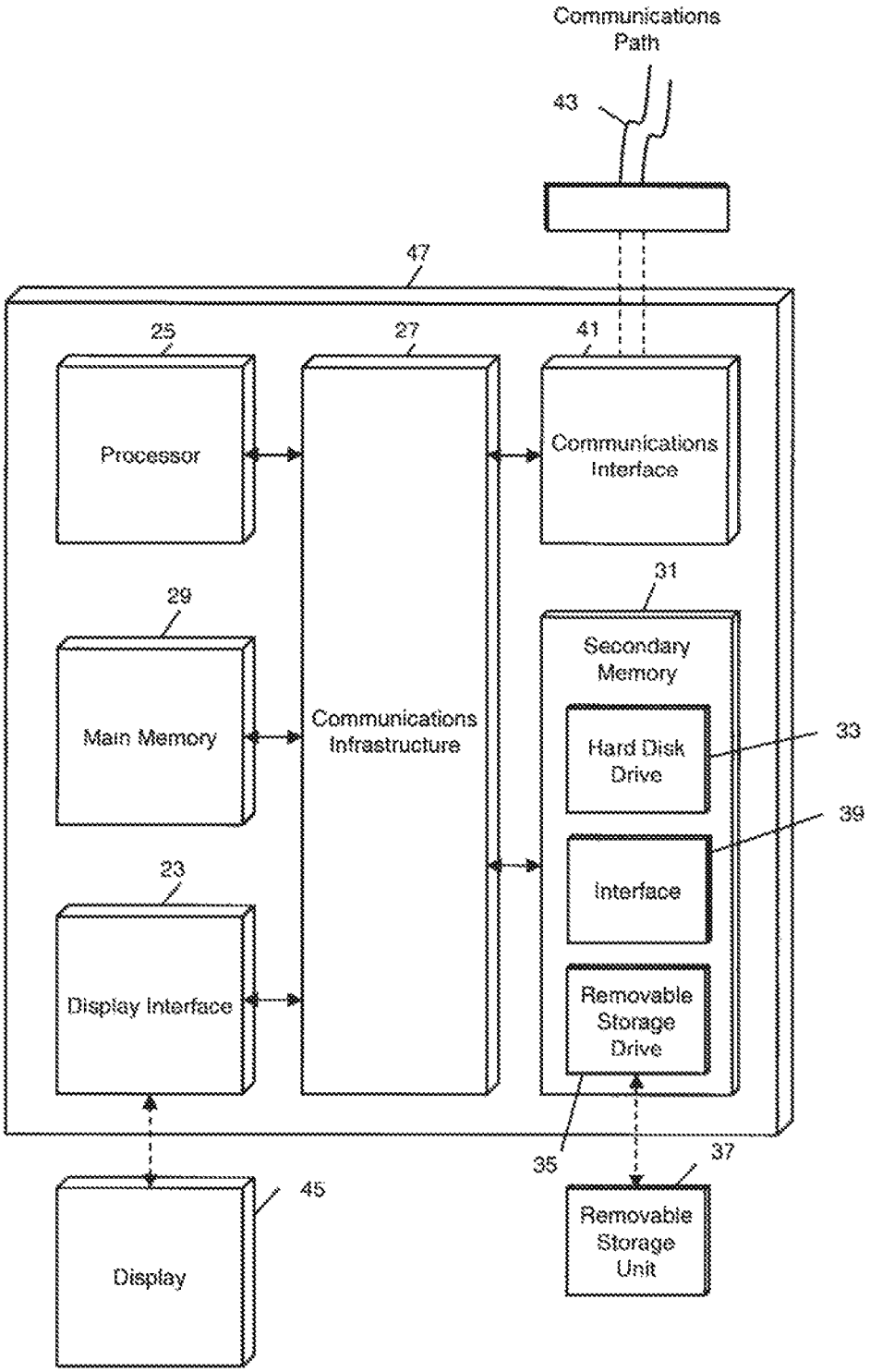
FIG. 5 is a block diagram illustrating a hardware architecture of a computing device in accordance with an exemplary embodiment.

FIG. 5 illustrates a computer system 47 (i.e. a client device, computing device, etc.) in which embodiments of the present disclosure, or portions thereof, can be implemented as computer-readable code compiled on a computer, thus making it a specific purpose computer. For example, the computing device 13 (e.g., smartphone, tablet, laptop, other mobile computing device, etc.) of FIGS. 1 and 2 can be implemented in the computer system 47 using hardware, software, firmware, non-transitory computer readable media having instructions stored thereon, or a combination thereof, and can be implemented in one or more computer systems or other processing systems. Hardware, software, or any combination thereof can embody modules and components used to implement the methods of FIGS. 3, 4, and 6.

If programmable logic is used, such logic can execute on a commercially available processing platform or a special purpose device. A person having ordinary skill in the art may appreciate that embodiments of the disclosed subject matter can be practiced with various computer system configurations, including multi-core multiprocessor systems, minicomputers, mainframe computers, computers linked or clustered with distributed functions, as well as pervasive or miniature computers that can be embedded into virtually any device. For instance, at least one processor device and a memory can be used to implement the above described embodiments.

A processor device as discussed herein can be a single processor, a plurality of processors, or combinations thereof. Processor devices can have one or more processor "cores." The terms "computer program medium," "non-transitory computer readable medium," and "computer usable medium" as discussed herein are used to generally refer to tangible media such as a removable storage unit 37, and a hard disk installed in hard disk drive 33.

Various embodiments of the present disclosure are described in terms of this exemplary computer system 47. After reading this description, it will become apparent to a person skilled in the relevant art how to implement the present disclosure using other computer systems and/or computer architectures. Although operations can be described as a sequential process, some of the operations can in fact be performed in parallel, concurrently, and/or in a distributed environment, and with program code stored locally or remotely for access by single or multi-processor machines. In addition, in some embodiments the order of operations can be rearranged without departing from the spirit of the disclosed subject matter.

Processor device 25 can be a special purpose or a general purpose processor device. The processor device 25 can be connected to a communication infrastructure 27, such as a bus, message queue, network, multi-core message-passing scheme, etc. The network can be any network suitable for performing the functions as disclosed herein and can include a local area network (LAN), a wide area network (WAN), a wireless network (e.g., WiFi), a mobile communication network, a satellite network, the Internet, fiber optic, coaxial cable, infrared, radio frequency (RF), or any combination thereof. Other suitable network types and configurations will be apparent to persons having skill in the relevant art. The computer system 47 can also include a main memory 29 (e.g., random access memory, read-only memory, etc.), and can also include a secondary memory 31. The secondary memory 31 can include the hard disk drive 33 and a removable storage drive 35, such as a floppy disk drive, a magnetic tape drive, an optical disk drive, a flash memory, etc. According to various embodiments, the main memory 28 and/or the secondary memory 31 can include the out-of-game peer-wagering module 5. According to various embodiments, the out-of-game peer-wagering module 5 can be alternatively implemented using hardware, firmware, software, or a combination thereof.

The removable storage drive 35 can read from and/or write to the removable storage unit 37 in a well-known manner. The removable storage unit 37 can include a removable storage media that can be read by and written to by the removable storage drive 35. For example, if the removable storage drive 35 is a floppy disk drive, the removable storage unit 37 can be a floppy disk. In one embodiment, the removable storage unit 37 can be non-transitory computer readable recording media.

In some embodiments, the secondary memory 31 can include alternative means for allowing computer programs or other instructions to be loaded into the computer system 47, for example, the removable storage unit 37 and an interface 39. Examples of such means can include a program cartridge and cartridge interface (e.g., as found in video game systems), a removable memory chip (e.g., EEPROM, PROM, etc.) and associated socket, and other removable storage units 37 and interfaces 39 as will be apparent to persons having skill in the relevant art.

Data stored in the computer system 47 (e.g., in the main memory 29 and/or the secondary memory 31) can be stored on any type of suitable computer readable media, such as optical storage (e.g., a compact disc, digital versatile disc, Blu-ray disc, etc.) or magnetic tape storage (e.g., a hard disk drive). The data can be configured in any type of suitable database configuration, such as a relational database, a structured query language (SQL) database, a distributed database, an object database, etc. Suitable configurations and storage types will be apparent to persons having skill in the relevant art.

The computer system 47 can also include a communications interface 41 (i.e., a transceiver). The communications interface 41 can be configured to allow software and data to be transferred between the computer system 47 and external devices. Exemplary communications interfaces 41 can include a modem, a network interface (e.g., an Ethernet card), a communications port, a PCMCIA slot and card, etc. Software and data transferred via the communications interface 41 can be in the form of signals, which can be electronic, electromagnetic, optical, or other signals as will be apparent to persons having skill in the relevant art. The signals may travel via a communications path 43, which can be configured to carry the signals and can be implemented using wire, cable, fiber optics, a phone line, a cellular phone link, a radio frequency link, etc.

Computer program medium and computer usable medium can refer to memories, such as the main memory 29 and secondary memory 31, which can be memory semiconductors (e.g., DRAMs, etc.). These computer program products can be means for providing software to the computer system 47. Computer programs (e.g., computer control logic) can be stored in the main memory 29 and/or the secondary memory 31. Computer programs can also be received via the communications interface 41. Such computer programs, when executed, can enable computer system 47 to implement the present methods as discussed herein. In particular, the computer programs, when executed, can enable processor device 25 to implement the method illustrated by FIGS. 3, 4, and 6 or similar methods, as discussed herein. Accordingly, such computer programs can represent controllers of the computer system 47. Where the present disclosure is implemented using software, the software can be stored in a computer program product or computer readable medium and loaded into the computer system 47 using the removable storage drive 35, interface 39, hard disk drive 33, or communications interface 41. Lastly, the computer system 47 can also include a display interface 23 that outputs display signals to a display unit 45, e.g., LCD screen, plasma screen, LED screen, DLP screen, CRT screen, etc.

The transactional server 15 and the third party game server 17 can also be implemented as computing devices similar to computer system 47.

Display Pages

FIGS. 7-15 illustrate exemplary display pages of the out-of-game peer-wagering module 5 that can be displayed on a display of the computing device. In an exemplary embodiment, the display pages can be pages displayed by a mobile application stored on a smartphone.

Figure 7:
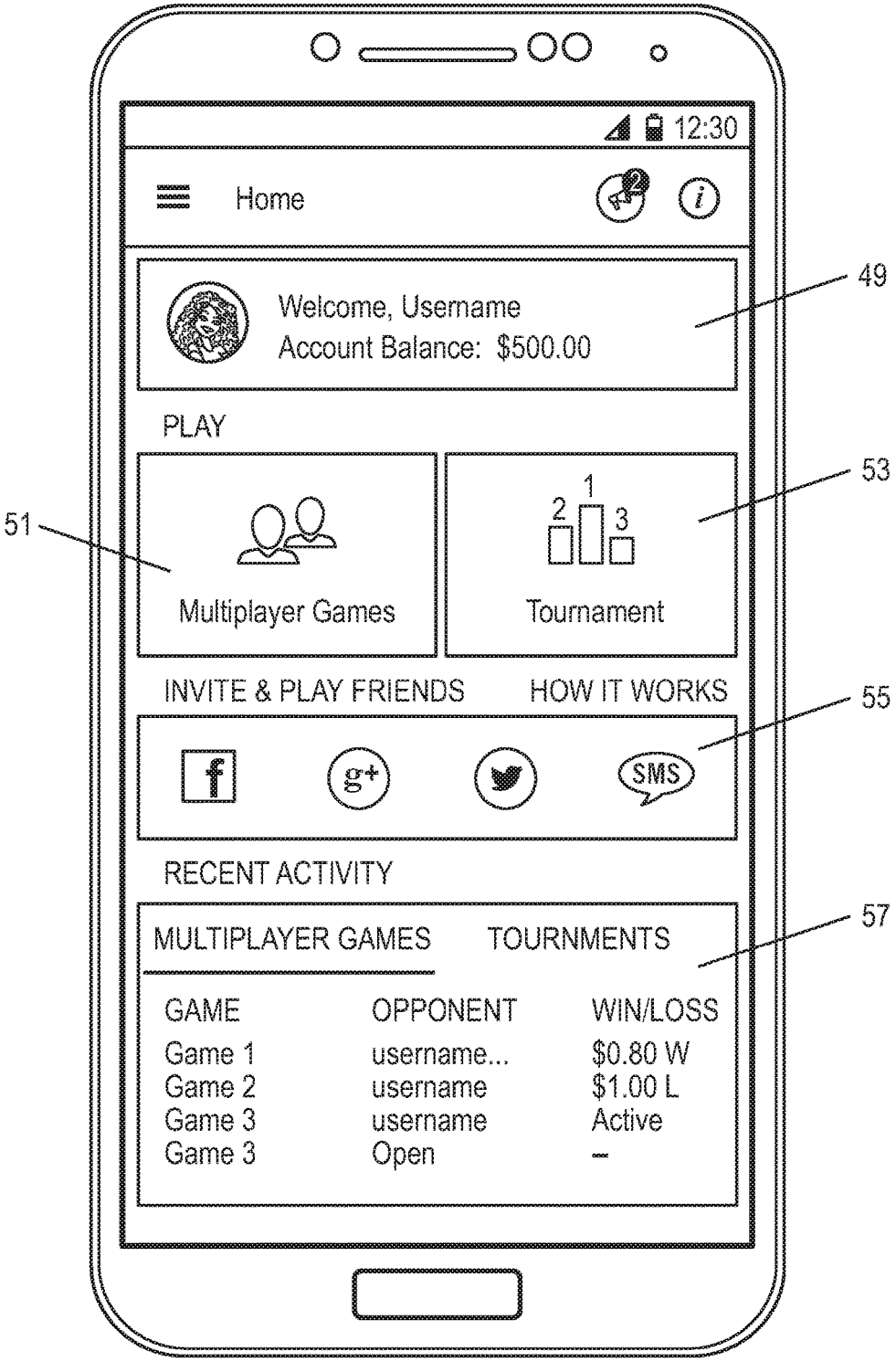
FIG. 7 is a graphical user interface of an exemplary embodiment.

The display page of FIG. 7 shows an exemplary embodiment of a home page of the out-of-game peer-wagering module 5 which can be accessed after a player has logged in. For example, this page can be shown after step S4 of FIG. 3 but before step S5. This page includes a player data area 49 that can include, for example, a profile picture of the player 3, the player's username, the player's account balance, etc. In an exemplary embodiment, a player can add or remove funds from their account by selecting the player data area 49 (e.g., touching this area of the touchscreen). Beneath the player data area 49 is a multiplayer game selection button 51 and a tournament game selection button 53. When the multiplayer game selection button 51 is selected, a plurality of multiplayer games (e.g., one player vs. another player or team of players vs. one or a plurality of teams of players) which can be played are displayed as in FIG. 8. When the tournament game selection button 53 is selected, a plurality of tournaments that can be entered into are displayed. The display page of FIG. 7 can also include a friend invite area 55 where a player can invite a friend or other person to play against them in a game or tournament. The friend invite area 55 has a Facebook icon, a Google plus icon, a Twitter icon, and a SMS icon. By selecting a particular icon, the player can message the contact and/or friend through the particular communication channel and/or send the contact and/or friend a peer-wager game instance invite request. This encourages players to invite/introduce their social network friends to create a peer-wagering module account and compete in skill-based games for cash with friends, contacts and/or anonymous opponents. A recent activity area 57 lists, for example, the recent games played, the name of the opponent/opponents, and amount of money won or lost. The display page of FIG. 7 can also include a notifications icon 50 that notifies the player of multiplayer/tournament game instance results, game invite requests, low account balance, and other pertinent notifications.

Figure 8:
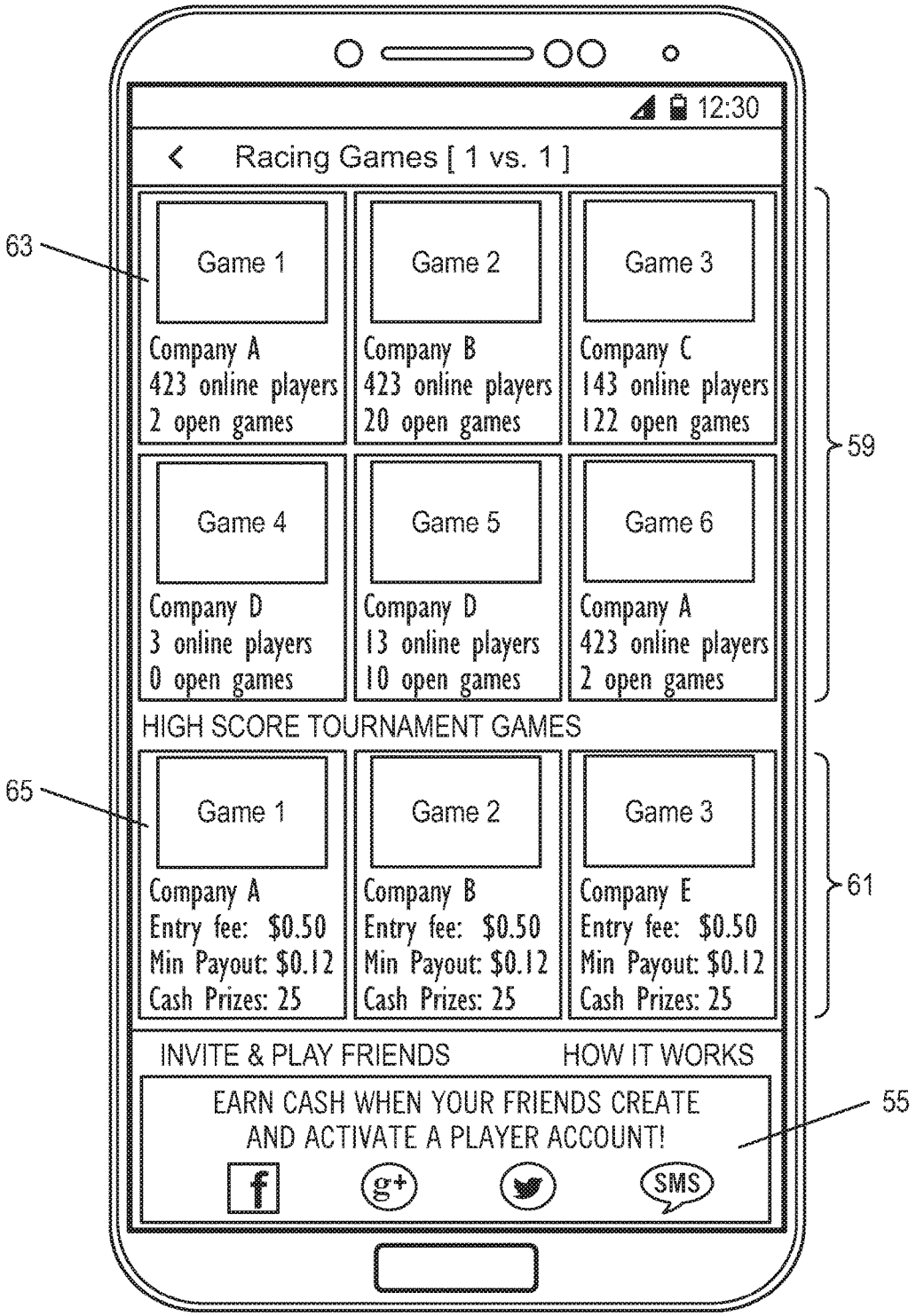
FIG. 8 is a graphical user interface of an exemplary embodiment.

The display page of FIG. 8 shows plurality of multiplayer game icons identifying games (e.g., 1 vs. 1 racing games) that can be selected to wager on against a competitor. The games can be of a particular genre, e.g., arcade, fighting, racing, sports, etc. In FIG. 8, the player had previously selected the racing genre within the multiplayer game genre dashboard. Now the player can see each individual games identified within the racing genre. In an exemplary embodiment, each game icon 63 can include information about the games such as game developer/publisher name, number of online players that have played the game or are online or available to play a game instance 9, number of open game instances 9 that are available to join, etc. The plurality of potential game instances 9 are contained within a game selection area 59. The display page of FIG. 8 can also include a high score tournament game area 61 that identifies a plurality of available high score tournament game instance(s) 9. In an exemplary embodiment, each tournament icon 65 can include information about each particular tournament such as game developer name, tournament entry fee, minimum payout amount, number of cash prizes, etc. The display page of FIG. 8 can also include the friend invite area 55.

Figure 9:
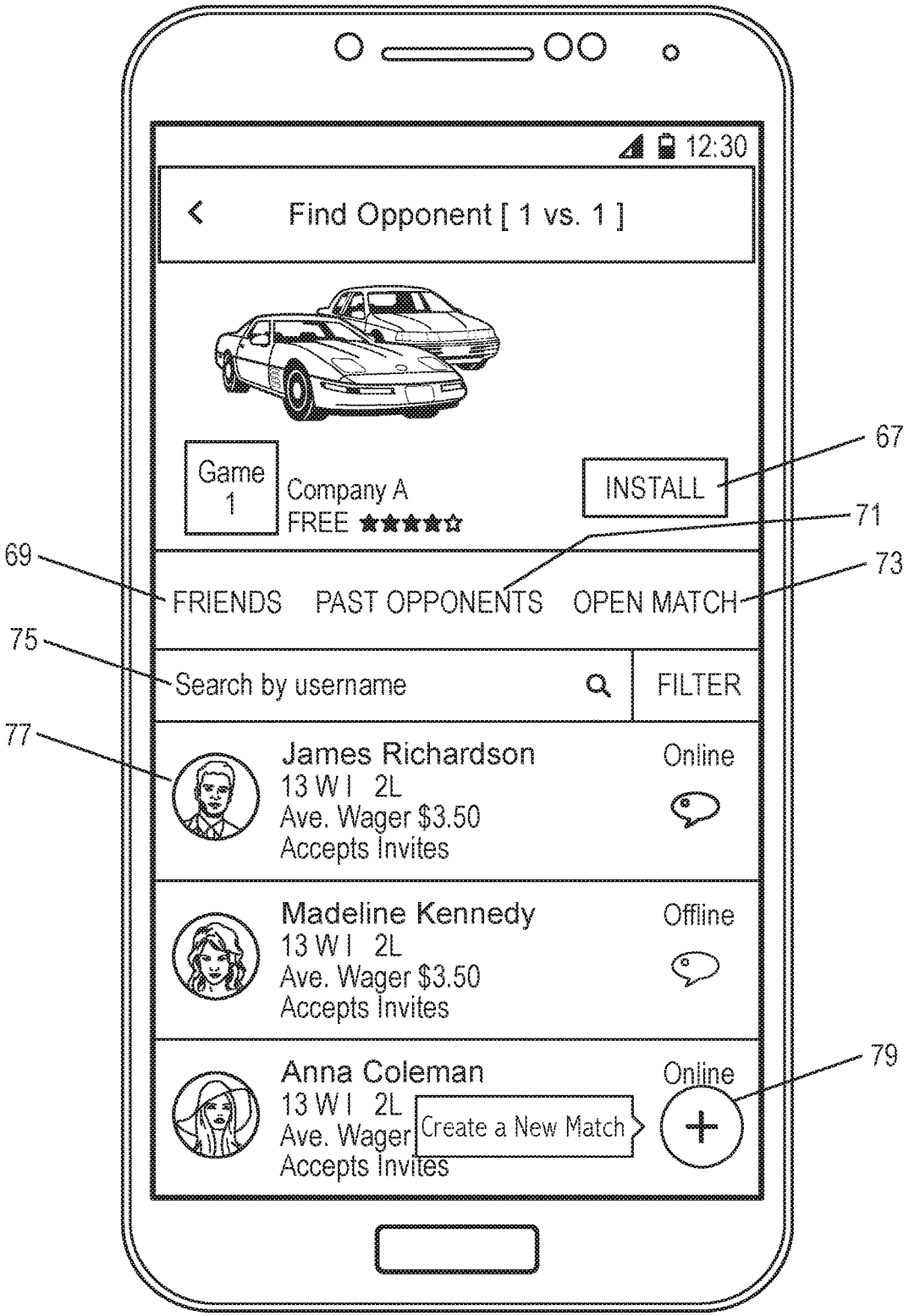
FIG. 9 is a graphical user interface of an exemplary embodiment.

The display page of FIG. 9 is a page in which the player 3 can find an opponent to play against in a multiplayer game (e.g., a 1 vs. 1 game). This page can include an install button 67. If the player does not already have the game stored on their computing device 13, they can select the install button 67 and download the game. The install button 67 can direct the player to an authorized/secure third party game download location or directly install the game program on the computing device without the player ever leaving the out-of-game peer-wagering module 5. This page can also include a friends tab 69 which when selected allows the player to view their friends, and they can choose one of them to compete against in the game. In FIG. 9, an opponent information area 77 is associated with each potential opponent. The opponent information area 77 identifies, for example, the potential opponent's name or username, picture or avatar, number of wins, number of losses, average wager amount, whether they accept invites, whether they are offline or online, etc. When the player selects an opponent in the information area 77 by, for example, by touching the name of the opponent or area around the opponent name, a player communication dialog area of FIG. 10 opens for player communication and a new match icon 79 appears which when selected creates a new match with the selected opponent. After the create a new match icon 79 is selected, the player can select the game, game instance settings, and wager amounts, and the player can invite opponents to compete in the game instance 9 or leave the game instance 9 open. If the game instance 9 is left open, it will be located under an open game instances 9 tab 73. The display page of FIG. 9 can also include a past opponents tab 71 which when selected lists previous opponents. The display page of FIG. 9 can also include the open game instances 9 tab 73 which when selected lists game instances 9 that are open (i.e., have not begun) which the player can join. Open matches are matches that other players have created and are still waiting for a player or players to accept. FIG. 9 can also include a search field 75 which allows the player to search for opponents by keywords (e.g., name, username, etc.). Game instances 9 and player 3 opponents can also be filtered by selecting the filter button. For example, opponents can be filtered by their average wager amount. For example, a range of their average wager amount, \$0.50-\$1.99, \$2.00-\$4.99, \$5.00-\$9.99, etc. Opponents can also be filtered by their online/offline status. For example, online now, online within the past 24 hours, online within the past three days, etc. Opponents can also be filtered by whether they can accept instant messaging or chatting. Opponents can be filtered by whether they accept new game invites or not.

Figure 10:
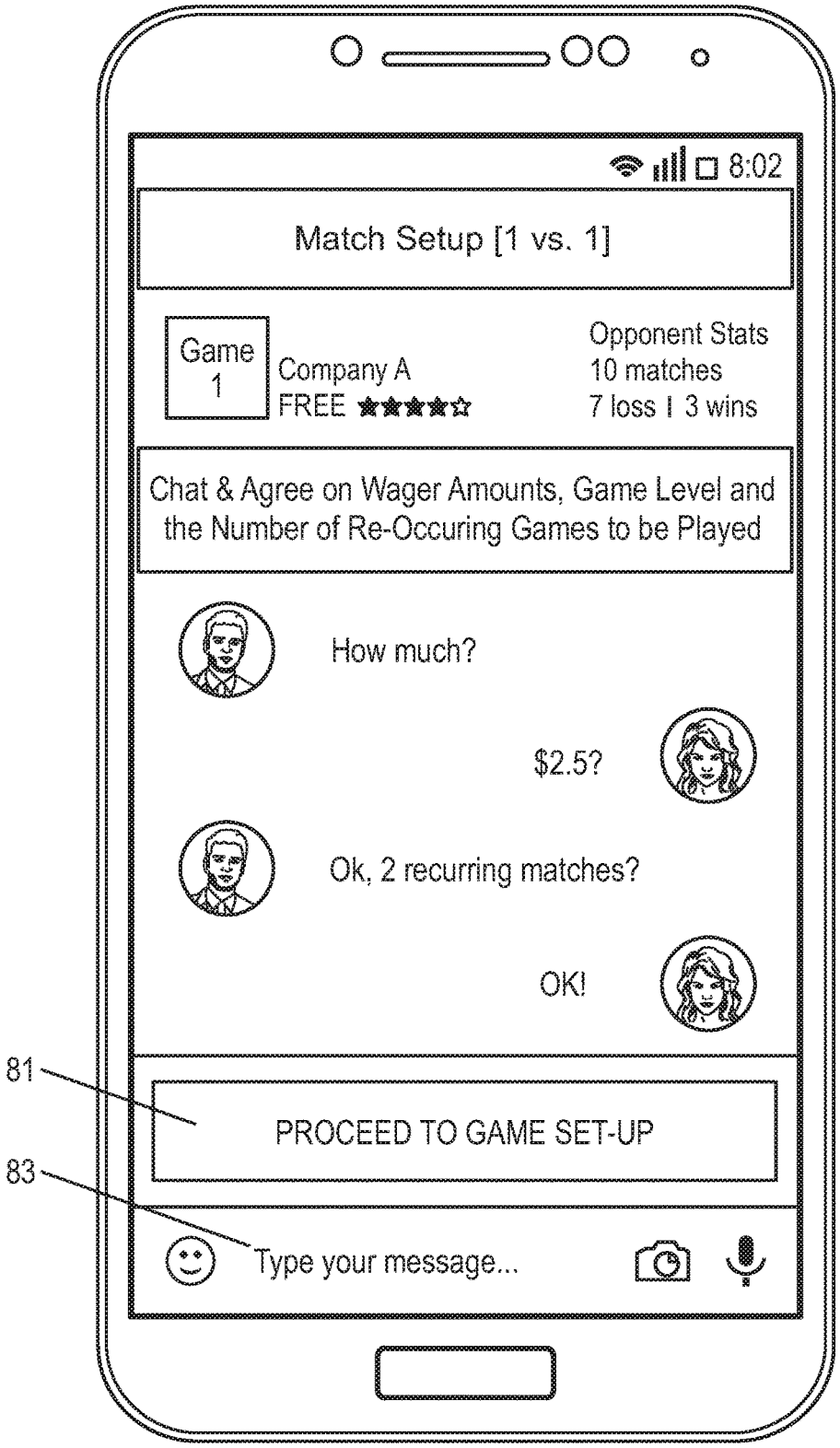
FIG. 10 is a graphical user interface of an exemplary embodiment.

Once an opponent is selected, the player can chat with their opponent using the display page of FIG. 10. For example, the players can message each other in order to determine wager amounts, game level, and number of re-occurring matches they want to play against each other. The player 3 enters in their message at message area 83. Once the player has finished communicating with the opponent player 3, they select the proceed to game set-up button 81. Each message in FIG. 10 that is associated with a particular player can include that player's profile picture. Message area 83 is able to accept pictures and voice recordings in addition to text.

Figure 11:
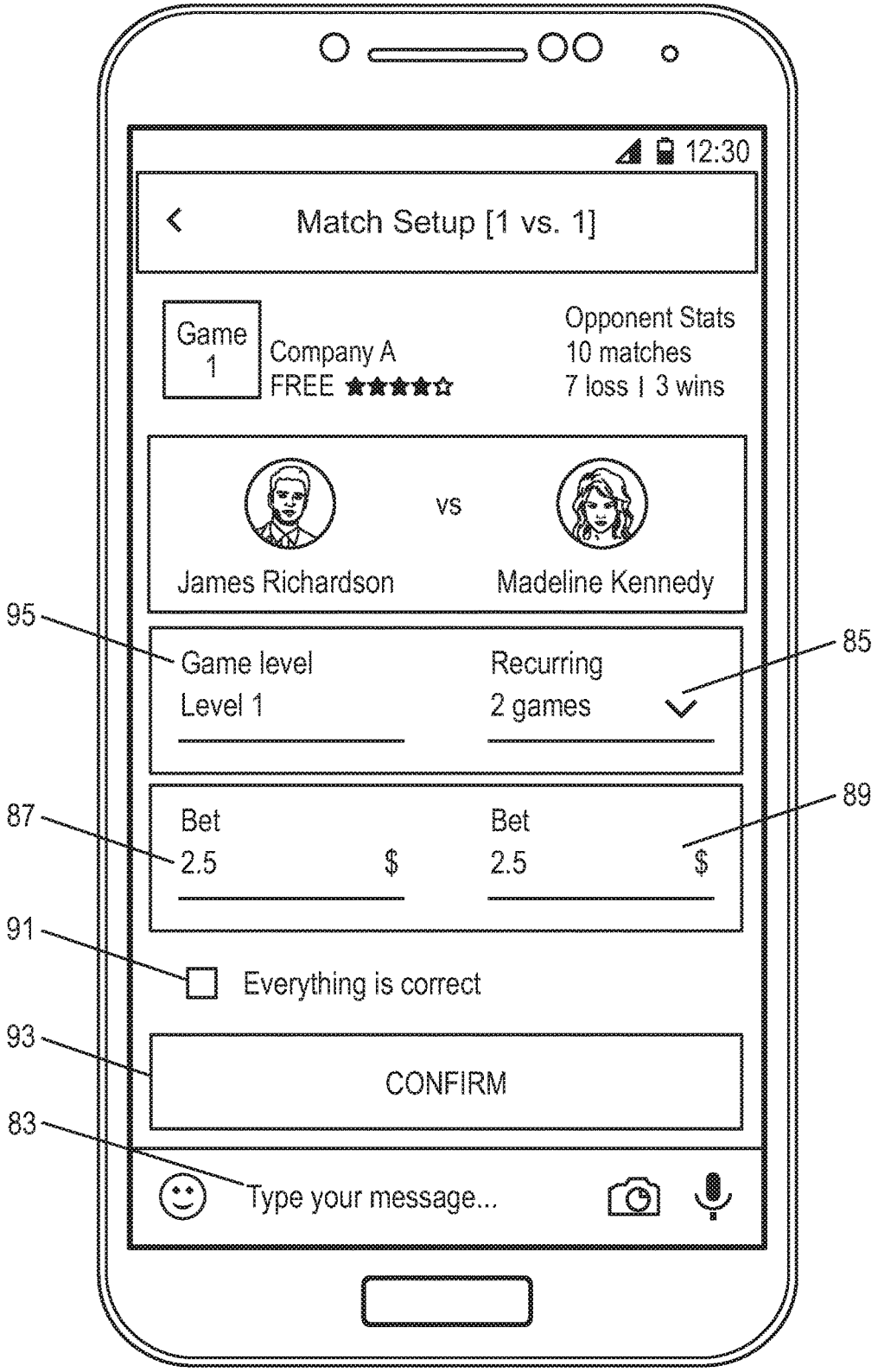
FIG. 11 is a graphical user interface of an exemplary embodiment.

The display page of FIG. 11 is a page in which the specifics of the match can be setup. This page identifies the players 3, and can include a game level selection area 95 in which the player can select the difficulty level of the game in which both players 3 will compete. This page also includes a reoccurring game number selection area 85 in which the number of reoccurring games to be played can be selected (e.g., two games, three games, etc.). This page also includes a bet area 87 and a bet area 89 in which the wager amounts for each player can be entered. The wager amounts do not have to be equal. Once the specifics of the match are entered, check box 91 is selected and the confirmation button 93 is selected. FIG. 11 also includes the message area 83. This page can be displayed at step S5 of FIG. 3 when the player selects and confirms a game instance (confirmation 1 of 2).

The display page of FIG. 12 is a page in which specifics of the match set up by an opponent can be confirmed, edited, or declined. This page can be shown, for example, at step S10 of FIG. 3 for player 3 confirmation of the game instance match ID data (confirmation 2 of 2). That is, this page is displayed when a player receives an invitation to play a game instance that has already been set up by an opponent. The specifics of the match that is setup are shown in the summary area 99 (e.g., game level, player 3 wager(s), opponent player 3 wager(s), number of reoccurring games, net wager for player, net wager for opponent, etc.). If the specifics of the match are suitable, the player selects the confirm button 101. If the player wishes to make changes to the specifics of the match, they select the edit button 103. The player can decline the match invitation altogether by selecting the decline button 105. This page also includes the message area 83 in which the player can communicate with the person who created the match invitation.

The display page of FIG. 13 is multiplayer game results screen (for example shown at step S19 of FIG. 3). This page can show the winner of the match, and the number of points or score of each player. It also indicates how much was won along with more specific wager and fee information such as gross and/or net wager amounts for each player, match fee percentage and/or amount for each player, win or loss amount for each player, and account balance for the player viewing the screen. This page includes a play again button 107 which when selected causes the match to be played again, and a new game button 109 which allows the player to setup a new game instance 9. This page can also include the message area 83 and the friend invite area 55.

The display page of FIG. 14 is a page that shows details of a particular upcoming tournament. This display page can include the install button 67. A tournament details area 111 shows the name of the game, rating of the game, cost to download the application for the game, the time remaining before the tournament begins, the tournament entry fee, and the number of payout positions. When the see all payout button 115 is selected, all payout positions and associated financial win amounts can be viewed. In reoccurring entry area 117, the player can select the number of reoccurring entries (i.e., two, three, etc.). If the player agrees to the specifics of the tournament entry or re-occurring set of tournament entries, the check box 97 is selected and the confirm tournament entry button 113 is selected. This page can be displayed at step S5 of FIG. 3 when the player selects and confirms a high score cash tournament (confirmation 1 of 2). In an exemplary embodiment, the out-of-game peer wagering module 5 also displays a filter tournaments display page in which tournaments can be filtered by genre, minimum payout (e.g., a range, \$100-\$499, etc.), and tournament status (e.g., active, ending within 24 hours, starting within 24 hours, starting within 3 days, etc.)

The display page of FIG. 15 is a page that shows the results of a tournament (for example shown at step S19 of FIG. 3). This page can display the name of the game, start date and time of the tournament, end date and time of the tournament, player score and leaderboard position in the tournament, entry fee, number of payout positions, amount won, and account balance amount. This page includes the play again button 107 which when selected causes the out-of-game peer-wagering module and/or transactional server to transmit tournament game instance match ID data to the completed third party game and/or third party game server, and a new game button 109 which allows the player to find and join other tournament game instances 9 using the same third party game or other third party game. This page also includes the friend invite area 55. Also, this page includes a tournament suggestion area 119 that recommends tournaments that the player may like.

While various exemplary embodiments of the disclosed system and method have been described above, it should be understood that they have been presented for purposes of example only, not limitations. It is not exhaustive and does not limit the disclosure to the precise form disclosed. Modifications and variations are possible in light of the above teachings or may be acquired from practicing of the disclosure, without departing from the breadth or scope. For example, the out-of-game peer-wagering module in some or all of the embodiments above can be implemented in an application stored on a mobile device; however in another exemplary embodiment the out-of-game peer-wagering module can be implemented in a website (either a full version or a mobile version) located on a server or computer that is accessed by a browser, program, or application on a mobile device (e.g., smartphone, tablet, etc.) or any other computing device (e.g., laptop computer, desktop computer, virtual reality wearable, gaming kiosk, etc.).

As can be seen above, the method and system for wagering on electronic online games-of-skill can be implemented in any number of ways as discussed above, or as will become apparent to those skilled in the art after reading this disclosure. These embodiments, as well as variations and modifications thereof that will occur to those skilled in the art, are encompassed by the method and system for wagering on electronic online games-of-skill. Hence, the scope of the method and system for wagering on electronic online games-of-skill is limited only by the meets and bounds as articulated in the claims appended hereto.

What is claimed is:

1. A method for wagering on a skills-based digital gaming competition, the method executing on one or more computing devices that include at least one data processor, a transceiver, and a storage device storing a peer-wagering module, the peer-wagering module including executable instructions which when executed by the at least one data processor of the one or more computing devices perform the method, the method comprising:

receiving, by the peer-wagering module, potential game data from a transactional server, wherein the potential game data includes information on at least one third party game the player can play;

receiving, by the peer-wagering module, selection information from the player that includes at least one selected game instance from among the at least one third party game and at least one wager amount the player wishes to wager on the at least one selected game instance;

transmitting, by the peer-wagering module, the selection information to the transactional server;

receiving, by the peer-wagering module, game instance match ID data generated by the transactional server or generating the game instance match ID data by the peer-wagering module, wherein the game instance match ID data includes at least one of:

credential data associated with the player, a wager amount of the player, and a board, level, or difficulty setting associated with the at least one selected game instance; and receiving, by the third party game, the game instance match ID data and game initiation data, thereby activating the at least one selected game instance on at least one of the one or more computing devices or another computing device for use by the player, wherein the peer-wagering module is external and distinct from the at least one selected game instance and the at least one third party game.

2. The method of claim 1, wherein prior to the receiving of the potential game data from the transactional server, the method further comprises:

receiving, by the peer-wagering module, the credential data associated with the player;

transmitting, by the peer-wagering module, authentication data to the transactional server, wherein the authentication data is based on the credential data; and receiving, by the peer-wagering module, a confirmation of the authentication data from the transactional server, wherein receipt of the confirmation logs the player into the peer-wagering module and allows use of the peer-wagering module, wherein after the credential data is received by the peer-wagering module, additional credential information is not needed by the selected third party game.

3. The method of claim 1, wherein the peer-wagering module does not alter a user interface or user interfaces of the game instance and the third party game.

4. The method of claim 1, wherein the game instance that is activated is automatically populated with data from the game instance match ID data that is transmitted to the third party game from the peer-wagering module or from a game server via the transactional server.

5. The method of claim 1, further comprising:

receiving, by the peer-wagering module, a game instance selection and a corresponding wager for one or a plurality of game instances, and the peer-wagering module causes a plurality of game instances to be launched in a sequential order.

6. The method of claim 1, further comprising:

receiving, by the peer-wagering module, game instance results data from the third party game or from a game server via the transactional server; and receiving, by the peer-wagering module, match summary report data from the transactional server, wherein the match summary report data includes win or loss amount for the player, account balance of the player, and statistics associated with one or more completed game instances completed by the player.

7. A non-transitory computer readable storage medium storing computer program instructions which, when executed by at least one data processor of one or more computing devices, cause the at least one data processor to implement a method for wagering on a skills-based digital gaming competition, the non-transitory computer readable storage medium storing a peer-wagering module, and the peer-wagering module including the computer program instructions, the method comprising:

receiving, by the peer-wagering module, potential game data from a transactional server, wherein the potential game data includes information on at least one third party game the player can play;

receiving, by the peer-wagering module, selection information from the player that includes at least one selected game instance from among the at least one third party game and at least one wager amount the player wishes to wager on the at least one selected game instance;

transmitting, by the peer-wagering module, the selection information to the transactional server;

receiving, by the peer-wagering module, game instance match ID data generated by the transactional server or generating the game instance match ID data by the peer-wagering module, wherein the game instance match ID data includes at least one of:

credential data associated with the player, a wager amount of the player, and a board, level, or difficulty setting associated with the at least one selected game instance; and receiving, by the third party game, the game instance match ID data and game initiation data, thereby activating the at least one selected game instance on at least one of the one or more computing devices or another computing device for use by the player, wherein the peer-wagering module is external and distinct from the at least one selected game instance and the at least one third party game.

8. The non-transitory computer-readable storage medium of claim 7, wherein prior to the receiving of the potential game data from the transactional server, the method further comprises:

receiving, by the peer-wagering module, the credential data associated with the player;

transmitting, by the peer-wagering module, authentication data to the transactional server, wherein the authentication data is based on the credential data; and receiving, by the peer-wagering module, a confirmation of the authentication data from the transactional server, wherein receipt of the confirmation logs the player into the peer-wagering module and allows use of the peer-wagering module, wherein after the credential data is received by the peer-wagering module, additional credential information is not needed by the selected third party game.

9. The non-transitory computer-readable storage medium of claim 7, wherein the peer-wagering module does not alter a user interface or user interfaces of the game instance and the third party game.

10. The non-transitory computer-readable storage medium of claim 7, wherein the game instance that is activated is automatically populated with data from the game instance match ID data that is transmitted to the third party game from the peer-wagering module or from a game server via the transactional server.

11. The non-transitory computer-readable storage medium of claim 7, further comprising:

receiving, by the peer-wagering module, a game instance selection and a corresponding wager for one or a plurality of game instances, and the peer-wagering module causes a plurality of game instances to be launched in a sequential order.

12. The non-transitory computer-readable storage medium of claim 7, further comprising:

receiving, by the peer-wagering module, game instance results data from the third party game or from a game server via the transactional server; and receiving, by the peer-wagering module, match summary report data from the transactional server, wherein the match summary report data includes win or loss amount for the player, account balance of the player, and statistics associated with one or more completed game instances completed by the player.

13. One or more computing devices for wagering on a skills-based digital gaming competition, comprising:

at least one data processor;

a transceiver; and a storage device storing a peer-wagering module, the peer-wagering module configured to:

receive potential game data from a transactional server, wherein the potential game data includes information on at least one third party game the player can play;

receive selection information from the player that includes at least one selected game instance from among the at least one third party game and at least one wager amount the player wishes to wager on the at least one selected third party game instance;

transmit the selection information to the transactional server; and generate game instance match ID data or receive game instance match ID data generated by the transactional server, wherein the game instance match ID data includes at least one of:

credential data associated with the player, a wager amount of the player, and a board, level, or difficulty settings associated with the at least one selected game instance;

wherein the third party game receives the game instance match ID data and game initiation data, thereby activating the at least one selected game instance on at least one of the one or more computing devices or another computing device for use by the player, wherein the peer-wagering module is external and distinct from the at least one selected game instance and the at least one third party game.

14. The one or more computing devices of claim 13, wherein the peer-wagering module is further configured to:

receive the credential data associated with the player;

transmit authentication data to the transactional server, wherein the authentication data is based on the credential data; and receive a confirmation of the authentication data from the transactional server, wherein receipt of the confirmation logs the player into the peer-wagering module and allows use of the peer-wagering module, wherein after the credential data is received by the peer-wagering module, additional credential information is not needed by the selected third party game.

15. The one or more computing devices of claim 13, wherein the peer-wagering module does not alter a user interface or user interfaces of the game instance and the third party game.

16. The one or more computing devices of claim 13, wherein the game instance that is activated is automatically populated with data from the game instance match ID data that is transmitted to the third party game from the peer-wagering module or from a game server via the transactional server.

17. The one or more computing devices of claim 13, wherein the peer-wagering module is further configured to:

receive a game instance selection and a corresponding wager for one or a plurality of game instances, and the peer-wagering module causes a plurality of game instances to be launched in a sequential order.

18. The one or more computing devices of claim 13, wherein the peer-wagering module is further configured to:

receive game instance results data from the third party game or from a game server via the transactional server; and receive match summary report data from the transactional server, wherein the match summary report data includes win or loss amount for the player, account balance of the player, and statistics associated with one or more completed game instances completed by the player.

19. The method of claim 1, wherein the received potential competitor data includes at least two potential players the player can compete against in a game, and the at least two third party games are each associated with respective game servers.

20. The method of claim 1, wherein the at least one or more computing devices that activate the at least one selected game instance is external and distinct to a computing device having the storage device that stores the peer-wagering module.

21. The non-transitory computer-readable storage medium of claim 7, wherein the at least one or more computing devices that activate the at least one selected game instance is external and distinct to a computing device having the storage device that stores the peer-wagering module.

22. The one or more computing devices of claim 13, wherein the at least one or more computing devices that activate the at least one selected game instance is external and distinct to a computing device having the storage device that stores the peer-wagering module.

* * * * *